US010444656B2

(12) United States Patent
Kanazawa

(10) Patent No.: US 10,444,656 B2
(45) Date of Patent: Oct. 15, 2019

(54) IMAGE FORMING APPARATUS

(71) Applicant: CANON KABUSHIKI KAISHA, Tokyo (JP)

(72) Inventor: Takayuki Kanazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/988,290

(22) Filed: May 24, 2018

(65) Prior Publication Data

US 2018/0341192 A1 Nov. 29, 2018

(30) Foreign Application Priority Data

May 25, 2017 (JP) ..... 2017-104005

(51) Int. Cl.
*G03G 15/02* (2006.01)
*G03G 21/16* (2006.01)
*G03G 21/00* (2006.01)

(52) U.S. Cl.
CPC ..... *G03G 15/0266* (2013.01); *G03G 15/0216* (2013.01); *G03G 21/0011* (2013.01); *G03G 21/169* (2013.01); *G03G 2215/021* (2013.01)

(58) Field of Classification Search
CPC ..... G03G 15/0266; G03G 15/0216; G03G 21/0011; G03G 21/169; G03G 2215/021
See application file for complete search history.

(56) References Cited

U.S. PATENT DOCUMENTS 8,175,475 B2 5/2012 Inami et al.
2012/0230710 A1* 9/2012 Gomi ..... G03G 15/0275 399/44
2016/0378053 A1* 12/2016 Kamimori ..... G03G 21/0035 399/71

FOREIGN PATENT DOCUMENTS

JP 2010-122468 A 6/2010
JP 2011-059218 A 3/2011

* cited by examiner

*Primary Examiner* — Ryan D Walsh
(74) *Attorney, Agent, or Firm* — Venable LLP

(57) ABSTRACT

An image forming apparatus includes an image bearing member, a charging member, a charging voltage source, an electrostatic image forming portion, a developing member, a developing voltage source, a transfer portion, a cleaning member, and a controller. The controller effects control so that a peak-to-peak voltage of an AC component of a charging voltage satisfying the following relationship is applied to the charging member to execute a toner supplying operation: 2Vth (V)≤Vpp1 (V)≤(2Vth+200) (V), where a discharge start voltage of a DC component of a charging voltage between the image bearing member and the charging member is Vth (V), and the peak-to-peak voltage of the AC component applied during execution of the toner supplying operation is Vpp1 (V). A peak-to-peak voltage of the AC component applied during image formation is larger than the peak-to-peak voltage Vpp1 (V).

21 Claims, 13 Drawing Sheets

IMAGE FORMING APPARATUS

FIELD OF THE INVENTION AND RELATED ART

The present invention relates to an image forming apparatus, such as a copying machine, a printer or a facsimile machine, using an electrophotographic type or an electrostatic recording type.

In the image forming apparatus using the electrophotographic type, as a type in which untransferred toner or the like is removed from an image bearing member in the case where transfer residual toner or a jam (recording material jam) generates, there is a type in which the toner residual toner is physically scraped off with a cleaning member provided in contact with the image bearing member. As the cleaning member, a cleaning blade formed of an elastic material such as an urethane rubber is widely used and is contacted to the image bearing member in a direction such that a free end portion thereof is oriented toward an upstream side of a rotational direction of the image bearing member.

In the case where the cleaning blade is used, when the image bearing member is rotated continuously in a state in which an amount of the toner supplied to the image bearing member is small, a frictional force between the image bearing member and the cleaning blade increases. As a result, the cleaning blade microscopically causes shuddering (vibration), so that improper cleaning occurs in some cases. The improper cleaning is a phenomenon such that the toner is not scraped off by the cleaning blade and slips through the cleaning blade (hereinafter this phenomenon is also simply referred to as "slip-through"). As a situation in which the image bearing member rotates in a state that the amount of the toner supplied to the image bearing member is small, the case where printing of an image with a low print ratio continues, the case where a preparatory rotation (pre-rotation step and post-rotation step before and after an image forming step) or the like case can be cited.

On the other hand, there is a method in which improper cleaning due to shuddering of a cleaning blade is suppressed by performing a supplying operation for supplying toner to a contact portion between the image bearing member and the cleaning blade during non-image formation and thus by reducing a frictional force by a lubricating effect with toner or an external additive. Japanese Laid-Open Patent Application (JP-A) 2010-122468 discloses that depending on a print ratio, a supply amount of toner in the supplying operation or an execution frequency of the supplying operation is controlled. Conventionally, in the supplying operation, a predetermined print pattern (solid black image or a thin line image) is formed on the image bearing member, and toner of this print pattern is supplied to the contact portion between the image bearing member and the cleaning blade.

Further, in the image forming apparatus using the electrophotographic type or the like, as a type in which the image bearing member is electrically charged, there is a type in which a charging bias is applied to a charging member provided in contact with or in proximity to the image bearing member and thus the image bearing member is charged. Further, as regards a type using the charging member, there is an AC charging type in which as the charging bias, an oscillating voltage in the form of a DC voltage biased with an AC voltage is applied to the charging member. The AC charging type has such an advantage that uniformity of a surface potential of the image bearing member after the charging is excellent by a potential leveling effect by AC discharge. On the other hand, in the AC charging type, an amount of abrasion of a surface of the discharge between the image bearing member and the charging member or an amount of generation of a discharge product is relatively large. JP-A 2011-59218 discloses a method in which improper cleaning is suppressed while suppressing generation of the discharge product by a applying to the charging member an AC voltage having a peak-to-peak voltage value not more than a discharge start voltage during non-image formation.

However, when a normal print pattern (solid black image or a thin line image) is formed on the image bearing member in the supplying operation as in the conventional method, improper cleaning occurs due to slip-through of toner itself of the print pattern in some cases. The toner constituting the print pattern has a sufficient electric charge in many cases, and one of causes of the improper cleaning is such that the toner is not readily scraped off by the cleaning blade due to a high mirror force of the toner. Further, the improper cleaning due to the toner of the print pattern has a tendency to become conspicuous in the case of using the AC charging type. This would be considered because in the case of using the AC charging type, electrical vibration is transmitted as a physical vibration to the image bearing member and thus a cleaning property of the cleaning blade lowers.

SUMMARY OF THE INVENTION

A principal object of the present invention is to provide an image forming apparatus capable of not only supplying toner to a contact portion between an image bearing member and a cleaning member during non-image formation but also suppressing occurrence of improper cleaning due to the toner.

According to an aspect of the present invention, there is provided an image forming apparatus comprising: a rotatable image bearing member configured to bear a toner image; a charging member configured to electrically charge a surface of the image bearing member; a charging voltage source configured to apply a charging voltage in the form of a DC component biased with an AC component to the charging member; electrostatic image forming means configured to form an electrostatic image on the charged surface of the image bearing member; a developing member configured to form the toner image by supplying toner to the electrostatic image formed on the image bearing member; a developing voltage source configured to apply a developing voltage to the developing member; transfer means configured to transfer the toner image from the image bearing member onto a toner image receiving member at a transfer position; a cleaning member contacting the image bearing member on a side downstream of the transfer position and upstream of a contact position with the charging member with respect to a rotational direction of the image bearing member; and a controller capable of causing the charging voltage source and the developing voltage source to apply the charging voltage and the developing voltage to the charging member and the developing member, respectively, for moving the toner from the developing member onto the image bearing member so as to execute a supplying operation for supplying the toner to the cleaning member during non-image formation, wherein the controller carries out control so that a peak-to-peak voltage of the AC component of the charging voltage satisfying the following relationship is applied to the charging member so as to execute the supplying operation: $2Vth\ (V) \leq Vpp1\ (V) \leq (2Vth+200)\ (V)$, where a discharge start voltage of the DC component of the charging voltage between the image bearing member and the charging member is Vth (V), and the peak-to-peak voltage of the AC component of the charging voltage applied during execution of the supplying operation is Vpp1 (V), wherein a peak-to-peak voltage of the AC component of the charging voltage applied during image formation is larger than the peak-to-peak voltage Vpp1 (V).

According to another aspect of the present invention, there is provided an image forming apparatus comprising: a rotatable image bearing member configured to bear a toner image; a charging member configured to electrically charge a surface of the image bearing member; a charging voltage source configured to apply a charging voltage in the form of a DC component biased with an AC component to the charging member; electrostatic image forming means configured to form an electrostatic image on the charged surface of the image bearing member; a developing member configured to form the toner image by supplying toner to the electrostatic image formed on the image bearing member; a developing voltage source configured to apply a developing voltage including at least a DC component to the developing member; transfer means configured to transfer the toner image from the image bearing member onto a toner image receiving member at a transfer position; a cleaning member contacting the image bearing member on a side downstream of the transfer position and upstream of a contact position with the charging member with respect to a rotational direction of the image bearing member; and a controller capable of causing the charging voltage source and the developing voltage source to apply the charging voltage and the developing voltage to the charging member and the developing member, respectively, for moving the toner from the developing member onto the image bearing member so as to execute a supplying operation for supplying the toner to the cleaning member during non-image formation, wherein the controller carries out control so that the DC component of the charging voltage and the DC component of the developing voltage which satisfy the following relationship are applied to the charging member and the developing member, respectively, so as to execute the supplying operation: $0\ (V) \leq |Vdc1-Vdev1|(V) < |Vdc2-Vdev2|\ (V)$, where the DC component of the charging voltage applied during execution of the supplying operation is Vdc1 (V), the DC component of the charging voltage applied during image formation is Vdc2 (V), the DC component of the developing voltage applied during execution of the supplying operation is Vdev1 (V), and the DC component of the developing voltage applied during image formation is Vdev2 (V).

Further features of the present invention will become apparent from the following description of exemplary embodiments with reference to the attached drawings.

DESCRIPTION OF EMBODIMENTS

An image forming apparatus according to the present invention will be specifically described.

Embodiment 1

Figure 1:
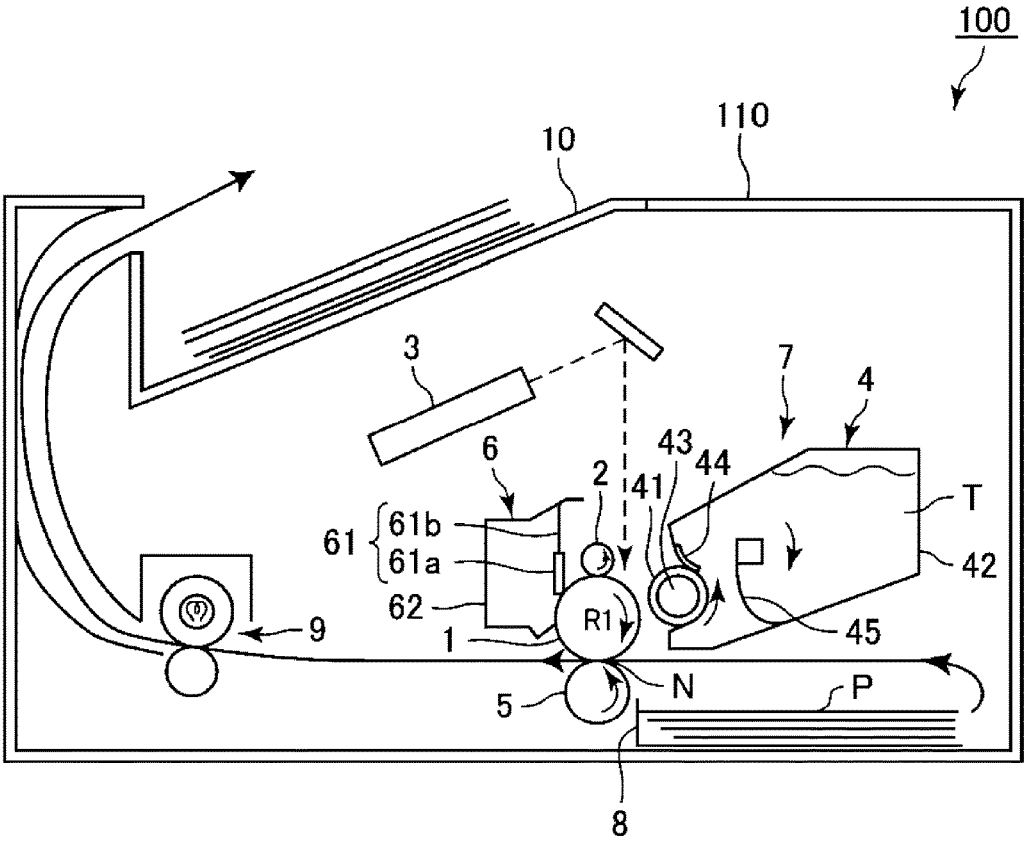
FIG. 1 is a schematic sectional view of an image forming apparatus.

FIG. 1 is a schematic sectional view of an image forming apparatus 100 of this embodiment. The image forming apparatus 100 of this embodiment is a laser beam printer using an electrophotographic type.

Figure 3:
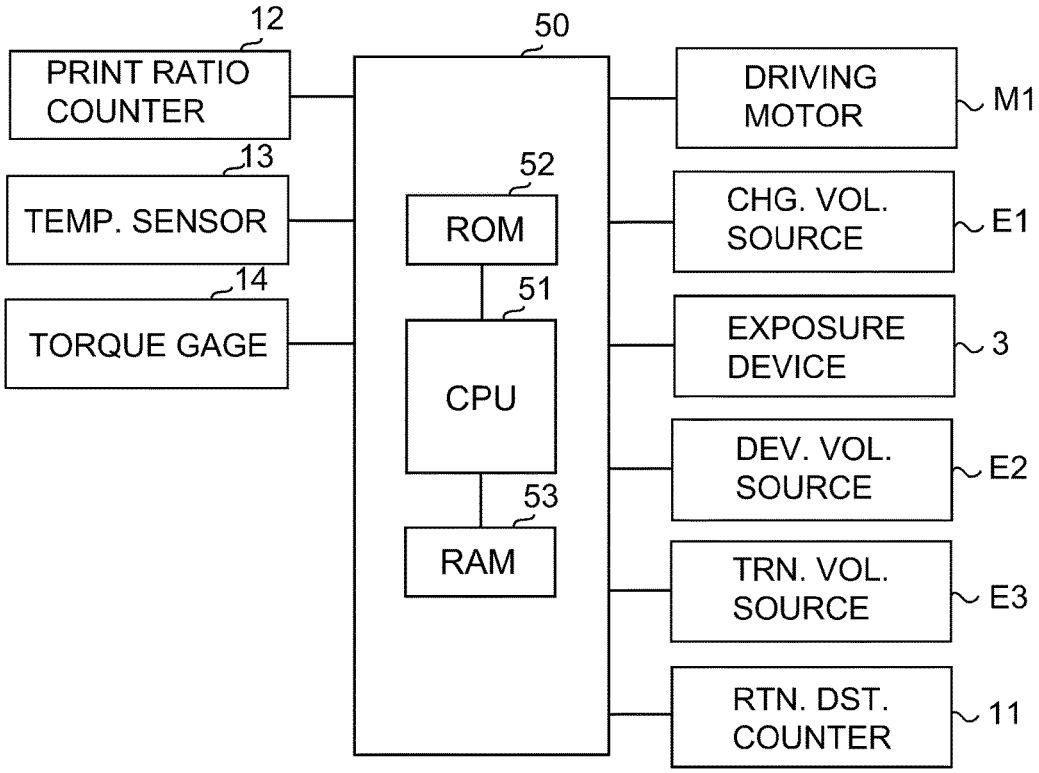
FIG. 3 is a schematic block diagram showing a control mode of a principal part of the image forming apparatus.

The image forming apparatus 100 includes a photosensitive drum 1 which is a rotatable drum-shaped electrophotographic photosensitive member as an image bearing member for bearing a toner image. The photosensitive drum 1 which is a rotatable member is rotationally driven in an arrow R1 direction in the figure by a driving motor M1 (FIG. 3) as a driving means. A surface of the rotating photosensitive drum 1 is electrically charged to a predetermined potential of a predetermined polarity (negative in this embodiment) by a charging roller 2 which is a roller-shaped charging member as a charging means. The charging roller 2 which is a rotatable member contacts the surface of the photosensitive drum 1 and is rotated by rotation of the photosensitive drum 1. During a charging step, to the charging roller 2, a charging bias (charging voltage) which is an oscillating voltage in the form of a DC voltage biased with an AC voltage is applied from a charging voltage source (high-voltage source circuit) E1 (FIG. 3). The charged surface of the photosensitive drum 1 is selectively exposed to light depending on image information by an exposure device 3 as an exposure means (electrostatic image forming means), so that an electrostatic image (electrostatic latent image) is formed on the photosensitive drum 1. In this embodiment, the exposure device 3 is a laser scanner for subjecting the surface of the photosensitive drum 1 to scanning exposure by reflecting laser light by a polygon mirror. The exposure device 3 successively exposes to light the photosensitive drum 1 along a sub-scan direction (surface movement direction) with rotation of the photosensitive drum 1 while scanning the photosensitive drum surface along a main scan direction (direction substantially parallel to a rotational axis direction).

The electrostatic image formed on the photosensitive drum 1 is developed (visualized) with toner supplied by a developing device 4 as a developing means. In this embodiment, the developing device 4 uses, as a developer, toner T which is a non-magnetic one-component developer. The developing device 4 includes a developing container 42 containing the toner T. Further, the developing device 4 includes a hollow cylindrical developing sleeve 41 as a developer carrying member (developing member) rotatably provided to the developing container 42 and includes a magnet roller 43 as a magnetic field generating means provided at a hollow portion of the developing sleeve 41. The developing device 4 further includes a developing blade 44 as a developer regulating member for regulating an amount of the toner T carried on the developing sleeve 41 and includes a stirring member 45 for stirring the toner T in the developing container 42. The toner T in the developing container 42 is supplied to the neighborhood of the developing sleeve 41 by the stirring member 45. The developing sleeve 41 which is a rotatable member is rotationally driven in an arrow direction in FIG. 1. Incidentally, in this embodiment, the developing sleeve 41 is rotationally driven in synchronism with the photosensitive drum 1 by a driving force transmitted from the driving motor M1 for driving the photosensitive drum 1. The toner T supplied to the neighborhood of the developing sleeve 41 is carried on the surface of the developing sleeve 41 by a magnetic force of the magnet roller 43. The toner T carried on the surface of the developing sleeve 41 is regulated in amount thereof by the developing blade 44 with rotation of the developing sleeve 41, and thereto, electric charges are imparted by friction with the developing blade 44. Thus, on the developing sleeve 41, a thin layer of the toner T is formed, so that the toner T is fed to an opposing portion to the photosensitive drum 1 with rotation of the developing sleeve 41. Further, during a developing step, to the developing sleeve 41, a developing bias (developing high voltage) which is an oscillating voltage in the form of a DC voltage biased with an AC voltage is applied from a developing voltage source (high voltage source circuit) E2 (FIG. 3). As a result, the toner is supplied from the developing sleeve 41 to the photosensitive drum 1 depending on the electrostatic image. In this embodiment, on an exposed portion of the photosensitive drum 1 where an absolute value of a potential is lowered by being subjected to exposure to light after the photosensitive drum surface is uniformly charged, the toner charged to the same polarity (negative in this embodiment) as a charge polarity of the photosensitive drum 1 deposits. That is, in this embodiment, a normal toner charge polarity which is a charging polarity of the toner during development is a negative polarity.

A transfer roller 5 which is a roller-shaped transfer member as a transfer means is provided opposed to the photosensitive drum 1. The transfer roller 5 is pressed toward the photosensitive drum 1 and forms a transfer portion (transfer nip) N where the photosensitive drum 1 and the transfer roller 5 contacts each other. The transfer roller 5 which is a rotatable member is rotated by rotation of the photosensitive drum 1. As described above, the toner image formed on the photosensitive drum 1 is transferred at the transfer portion N onto a recording material (transfer-receiving material, sheet) P such as a recording sheet sandwiched and fed by the photosensitive drum 1 and the transfer roller 5. During a transfer step, to the transfer roller 5, a transfer bias (transfer voltage) which is a DC voltage of an opposite polarity to the normal toner charge polarity is applied from a transfer voltage source (high voltage source circuit) E3 (FIG. 3). The recording material which is a toner image-receiving member is accommodated in a cassette 8 as an accommodating portion and is supplied to the transfer portion N by a feeding roller (not shown) by being timed to the toner image on the photosensitive drum 1.

The recording material P on which the toner image is transferred is fed to a fixing device 9 as a fixing means and is heated and pressed by the fixing device 9, so that the toner image is fixed (melted and fixed) on the recording material P. Thereafter, the recording material P is discharged (outputted) by a discharging roller (not shown) to a discharging portion 10 provided at an upper portion of an apparatus main assembly 110 of the image forming apparatus 100.

On the other hand, the toner (transfer residual toner) remaining on the surface of the photosensitive drum 1 during the transfer step is removed and collected from the surface of the photosensitive drum 1 by a cleaning device 6 as a cleaning means. The cleaning device 6 includes a cleaning blade 61 contacting the photosensitive drum 1 and a cleaning container 62. The cleaning device 6 scrapes the transfer residual toner off the surface of the rotating photosensitive drum 1 by the cleaning blade 61. The transfer residual toner scraped off the surface of the photosensitive drum 1 is stored in the cleaning container 62.

In this embodiment, the photosensitive drum 1 and as process means actable thereon, the charging roller 2, the developing device 4 and the cleaning device 6 integrally constitute a process cartridge 7 detachably mountable to the apparatus main assembly 110. The process cartridge 7 is exchanged to a new one in the case where the toner in the developing container 42 of the developing device 4 is used up, for example.

Figure 2:
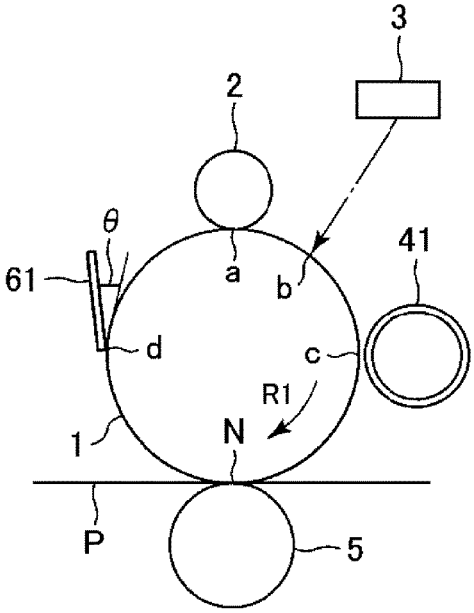
FIG. 2 is a schematic view showing an arrangement of members around a photosensitive drum.

Here, FIG. 2 is a schematic view showing an arrangement of members around the photosensitive drum 1. A position where the photosensitive drum 1 is charged by the charging roller 2 with respect to a rotational direction of the photosensitive drum 1 is a charging position a. In this embodiment, the charging roller 2 charges the photosensitive drum 1 by electric discharge generating at least one of minute gaps, between the charging roller 2 and the photosensitive drum 1, formed on an upstream side and a downstream side of a contact portion between the charging roller 2 and the photosensitive drum 1 with respect to the rotational direction of the photosensitive drum 1. However, for simplicity, it may also be considered that the contact portion between the charging roller 2 and the photosensitive drum 1 is deemed to be the charging bias position a. Further, with respect to the rotational direction of the photosensitive drum 1, a position where the exposure of the photosensitive drum surface to light by the exposure device 3 is an exposure position (image forming position) b. Further, with respect to the rotational direction of the photosensitive drum 1, a position where the toner is supplied from the developing sleeve 41 to the photosensitive drum 1 (in this embodiment, an opposing portion between the developing sleeve 41 and the photosensitive drum 1) is a developing position c. Further, with respect to the rotational direction of the photosensitive drum 1, a position where the toner image is transferred from the photosensitive drum 1 onto the recording material P (in this embodiment, a contact portion between the photosensitive drum 1 and the transfer roller 5) is a transfer position (transfer portion) N. Further, with respect to the rotational direction of the photosensitive drum 1, a contact portion between the cleaning blade 61 and the photosensitive drum 1 is a cleaning position d. In this embodiment, the above-described positions are disposed along the rotational direction of the photosensitive drum 1 in the order of the charging position a, the exposure position b, the developing position c, the transfer position N and the cleaning position d.

The image forming apparatus 100 executes a job (printing operation) which is a series of operations, which are started by a single starting instruction, for outputting the image (images) on a single or a plurality of recording materials P. The job includes in general an image forming step, a pre-rotation step, a sheet interval step in the case where the images are formed on the plurality of recording materials P, and a post-rotation step. The image forming step is performed in a period in which for the image to be actually formed and outputted on the recording material P, formation of the electrostatic image, formation of the toner image and transfer of the toner image are carried out, and during image formation refers to this period. Specifically, timing during image formation is different at each of the positions where the formation of the electrostatic image, the formation of the toner image and the transfer of the toner image are carried out. The pre-rotation step is performed in a period, before the image forming step, from input of the start instruction until the image is actually started to be formed. The sheet interval step is a period corresponding to an interval between two recording materials P when image formation on the plurality of recording materials P is continuously carried out (continuous image formation). The post-rotation step is performed in a period in which a post operation (preparatory operation) after the image forming step is performed. During non-image formation is a period other than during image formation and includes the periods of the pre-rotation step, the sheet interval step, the post-rotation step, and in addition, during main switch actuation of the image forming apparatus 100, a pre-multi-rotation step which is a preparatory operation step during restoration from a sleeve state, or the like. In this embodiment, a supplying operation described later is executed during non-image formation.

FIG. 3 is a schematic block diagram showing a control mode of a principal part of the image forming apparatus 100. In this embodiment, a controller (control circuit) 50 as a control means provided in the apparatus main assembly 110 of the image forming apparatus 100 effects integral control of operations of the respective portions of the image forming apparatus 100. The controller 50 is constituted by a CPU 51 as a calculation control means and a ROM 52 and a RAM 53 which are storing means, and the like. In the ROM 52, programs executed by the CPU 51 and various data are stored. The RAM 53 is used as a memory for an operation of the CPU 51. To the controller 50, the charging voltage source E1, the developing voltage source E2, the transfer voltage source E3, the driving motor M1, the exposure device 3, and the like are connected. Further, to the controller 50, a rotation distance counter (storing portion) 11 as a counting means is connected. The controller 50 integrates a rotation distance (movement distance with respect to the rotational direction) of the photosensitive drum 1 every drive of the photosensitive drum 1 and stores the rotation distance in the rotation distance counter 11. In this embodiment, as described later, the controller 50 controls the respective portions and thus carries out control of the supplying operation performed during non-image formation. Incidentally, in FIG. 3, for convenience, also elements described in other embodiments are described. A print ratio counter 12 and a temperature sensor 13 which are shown in FIG. 3 will be described later in Embodiment 2, and a torque gauge 14 shown in FIG. 3 will be described later in Embodiment 3.

2. Developer

In this embodiment, the toner used in the developing device 4 is polymerization toner manufactured by a suspension polymerization method. This voltage is manufactured in the following manner. First, a styrene-based polymerizable monomer and colorants (magnetic powder, a polymerization initiator, a crosslinking agent, a charge control agent, another additive) are uniformly dissolved or dispersed, so that a polymerizable monomer composition is prepared. This polymerizable monomer composition is dispersed in a continuous layer (for example, an aqueous phase) containing a dispersion stabilizer by using an appropriate stirring device, and is concurrently subjected to a polymerization reaction, so that toner (toner base material) with a weight-average particle size of 8 In order to adjust flowability and a charging property of the toner, powder (external additive) such as silica of several nm to several tens of nm is added to the surface of the toner. In this embodiment, as a material of the toner, such a material that the toner is negatively charged when a thin layer is formed by coating the developing sleeve 41 with the toner is selected.

3. Photosensitive Drum

In this embodiment, the photosensitive drum 1 constituted by laminating, on an aluminum cylinder as a supporting member formed of an electroconductive material, an undercoat layer having an electrical barrier property, a charge generating layer and a charge transporting layer in a named order. The charge transporting layer charging an outermost surface of the photosensitive drum 1 contacting the charging roller 2 is formed using polycarbonate resin. In this embodiment, the photosensitive drum 1 is rotationally driven at a peripheral speed (process speed) of 200 mm/s. Further, in this embodiment, a surface potential of the photosensitive drum 1 formed by electrically charging the photosensitive drum 1 by the charging roller 2 (hereinafter this potential is referred to also as a "dark (portion) potential") is −400 V. In this embodiment, a surface potential of the photosensitive drum 1 formed by subjecting the photosensitive drum 1 to light by the exposure device 3 (hereinafter, this potential is referred to as a "light (portion) potential") is −100 V.

4. Cleaning Blade

The cleaning blade 6 is an example of a cleaning member for removing the toner from the image bearing member in contact with the image bearing member at a position downstream of the transfer position N and upstream of the charging position a with respect to the rotational direction of the image bearing member. In this embodiment, the cleaning blade 61 is constituted by including a supporting metal plate 61*b* as a supporting member and a rubber portion 61*b* having elasticity. The supporting metal plate 61*b* is fixed to the cleaning container 62. The rubber portion 61*a* is formed of a polyurethane rubber as an elastic material. The rubber portion 61*a* is a plate-like member has a predetermined length in each of a longitudinal direction extending along a longitudinal direction (rotational axis direction) of the photosensitive drum 1 and a widthwise direction substantially perpendicular to the longitudinal direction and has a predetermined thickness. The longitudinal length of the rubber portion 61*a* is longer than a width of an image formable (region where the toner image is formable) with respect to the rotational axis direction of the photosensitive drum 1, and the image formable region falls within a range of the longitudinal length of the rubber portion 61*a*. The rubber portion 61*a* is fixed to the supporting metal plate 61*b* at one widthwise end portion thereof and a free end portion thereof as the other end portion is contacted to the surface of the photosensitive drum 1. The cleaning blade 61 is contacted to the surface of the photosensitive drum 1 with respect to a counter direction such that the free end portion of the rubber portion 61*a* is oriented toward an upstream side of the rotational direction of the photosensitive drum 1.

In this embodiment, the rubber portion 61*a* is 75° in Wallace hardness and 2 mm in thickness. Further, in this embodiment, the rubber portion 61*a* is contacted to the photosensitive drum 1 under setting of a contact angle of 30° and a contact pressure (set pressure) of 30 gf/cm. Incidentally, the contact angle refers to an angle (θ in FIG. 2) formed by a side surface of the rubber portion 61*a* on the photosensitive drum 1 side and a tangential line of the photosensitive drum 1 at a contact portion between the photosensitive drum 1 and the rubber portion 61*a* in a cross-section substantially perpendicular to the rotational axis direction of the photosensitive drum 1. Further, the contact pressure represents a line pressure which is a pressure per unit length in the longitudinal direction of the cleaning blade 61 (i.e., which is a value obtained by dividing a total contact pressure of the cleaning blade 61 to the photosensitive drum 1 by a longitudinal length of the contact portion between the photosensitive drum 1 and the cleaning blade 61). The line pressure can be acquired by measuring a load in a state in which a load converter is attached to the photosensitive drum 1 or a measuring tool corresponding to the photosensitive drum 1 and then the cleaning blade 61 is pressed against the photosensitive drum 1 or the measuring tool. When the contact pressure is excessively low, a cleaning property cannot be ensured. On the other hand, when the contact pressure is excessively high, a frictional force between the photosensitive drum 1 and the cleaning blade 61 becomes excessively high. Further, the cleaning blade 61 causes shuddering (vibration) and turning-up (which is a phenomenon that the free end portion of the rubber portion 61*a* is turned up toward the downstream side with respect to the rotational direction of the photosensitive drum 1 in some cases. The shuddering of the cleaning blade 61 causes improper cleaning. Further, the turning-up of the cleaning blade 61 causes the improper cleaning and leads to breakage of the device depending on the situation.

Further, even in the case where the contact pressure is appropriately set, when the photosensitive drum 1 is continuously rotated in a state in which an amount of the toner supplied to the photosensitive drum 1 is small, in some cases, the cleaning blade 61 causes the shuddering and the turning-up thereof. The image forming apparatus 100 in this embodiment executes the supplying operation described later for suppressing the shuddering and the turning-up.

5. Charging Roller

In this embodiment, the charging roller 2 is constituted by forming an electroconductive elastic layer formed of a hydrin rubber on an electroconductive core metal (core material) formed of iron, stainless steel (SUS) or the like and then by coating the elastic layer with a surface layer (protective layer) formed of an urethane rubber or the like. To the core metal of the charging roller 2, the charging voltage source E1 is connected. To the charging roller 2, a charging bias which is an oscillating voltage in the form of a DC voltage (DC component) superposed with an AC voltage (AC component) is applied from the charging voltage source E1 via the core metal. In this embodiment, during image formation, a charging bias in the form of a DC voltage of −400 V superposed with an AC voltage having a peak-to-peak voltage value Vpp (hereinafter, referred also simply as "Vpp") of 1500 V is applied to the charging roller 2. As a result, during image formation, the surface of the photosensitive drum 1 is substantially uniformly charged to a dark potential of −400 V.

6. Charging Property

A charging property (characteristic) of the photosensitive drum 1 by the charging roller 2 will be described. Incidentally, in some cases, the DC component and the AC component of the charging bias are referred to as a "charging DC" and a "charging AC", respectively, and the DC member and the AC component of the developing bias are referred to as a "developing DC" and a "developing AC", respectively.

Figure 4:
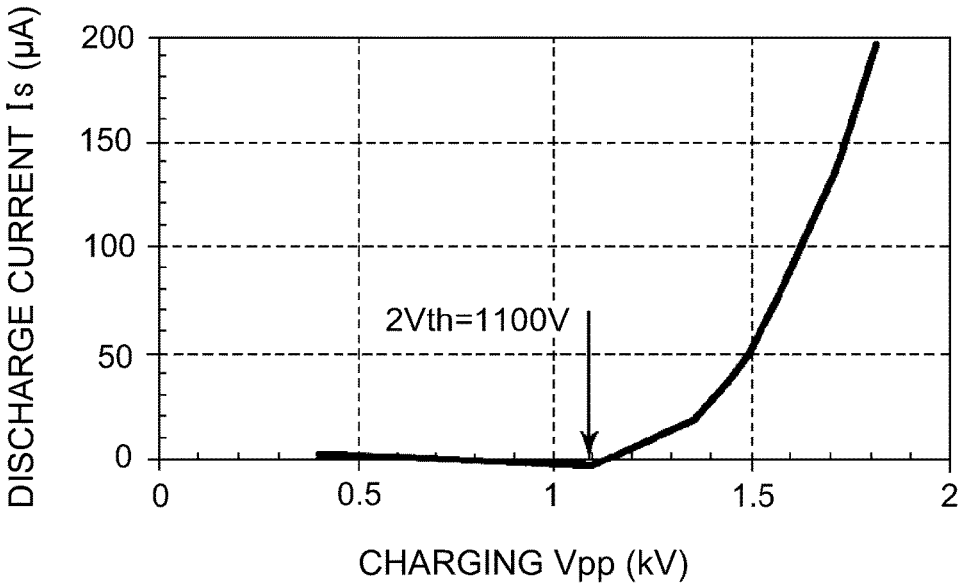
FIG. 4 is a graph showing a relationship between a peak-to-peak voltage of a charging bias and a discharge current amount.

FIG. 4 is a graph showing a relationship between Vpp of the charging AC and a discharge current amount Is in this embodiment. As shown in FIG. 4, in this embodiment, when the Vpp of the charging AC reaches 1100 V, the discharge current amount Is starts to increase. In this case, the Vpp of the charging AC at which the discharge current amount Is starts to increase is referred to as a "discharge start voltage 2Vth" between the photosensitive drum 1 and the charging roller 2. Incidentally, the discharge start voltage 2Vth corresponds to about twice Vth which is a voltage (discharge threshold) at which the electric discharge starts between the photosensitive drum 1 and the charging roller 2 when a voltage consisting only of the DC component is applied to the charging roller 2. The discharge start voltage 2Vth increases and decreases in accordance with the Paschen's law depending on a gap distance and pressure between the charging roller 2 and the photosensitive drum 1.

In this embodiment, in the case where the Vpp of the charging AC is less than 1100 V, the discharge current amount Is is substantially 0 μA and a discharge phenomenon does not generate, and therefore, the surface of the photosensitive drum 1 cannot be charged to a desired state (state in which the photosensitive drum surface is charged substantially uniformly to the potential of the charging DC). That is, a surface potential of the photosensitive drum 1 after passing through the charging position a becomes a surface potential of the photosensitive drum 1 in a state in which the photosensitive drum 1 is influenced by the exposure at the exposure position b or by the transfer at the transfer position N, before the photosensitive drum surface reaches the charging position a. In the case where the Vpp of the charging AC is 1100 V, the discharge phenomenon occurs, so that the surface of the photosensitive drum 1 can be charged to some degree. However, only relatively weak electric discharge generates, and therefore, charging non-uniformity generates, so that a region where the surface potential does not reach a predetermined potential (potential of the charging DC) generates on the surface of the photosensitive drum 1. As a result, a kind of "background fog" described later generates. When the Vpp of the charging exceeds 1100 V and then is gradually increased, the discharge current amount Is increases and thus strong electric discharge generates, so that the surface of the photosensitive drum 1 can be charged to a desired state.

Here, in the image forming apparatus using the electrophotographic type, there is a phenomenon that the toner deposits on a dark potential portion of the surface of the photosensitive drum 1. This phenomenon is referred to as a "fog". In general, the fog is controlled by a potential difference between a dark potential of the photosensitive drum 1 after the charging and a potential of the developing sleeve 41 (hereinafter, this potential is referred also to as a "developing potential"). This potential difference is referred to as a "back contrast". Generally, the back contrast is set so that with respect to electric charges held by the toner, an electric field formed between the photosensitive drum 1 and the developing sleeve 41 becomes an electric field in which the toner is not moved from the developing sleeve 41 side toward the photosensitive drum 1 side.

Figure 5:
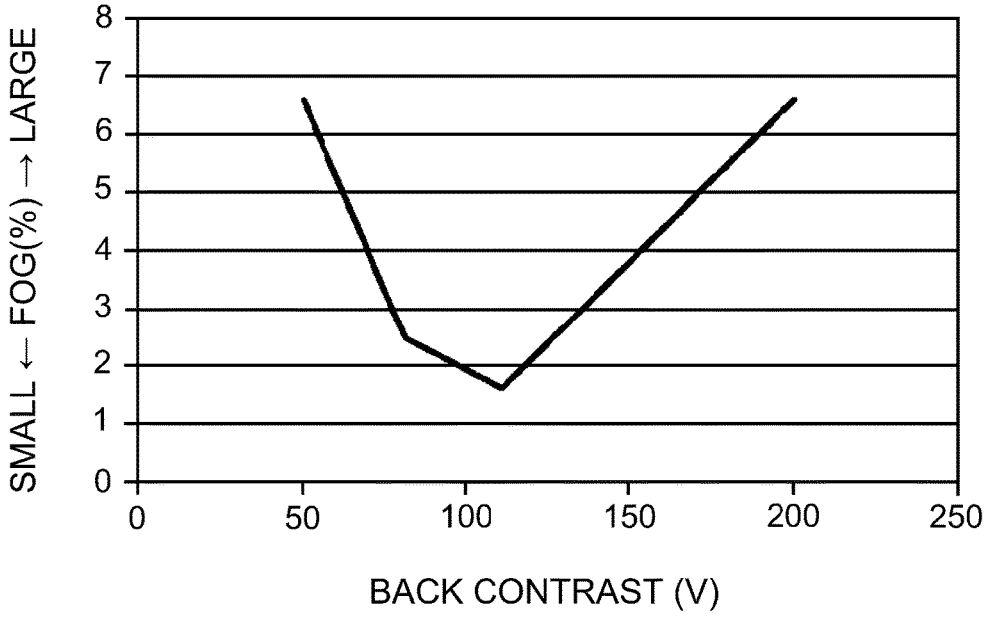
FIG. 5 is a graph showing a relationship between a back contrast and a degree of generation of a fog.

FIG. 5 is a graph showing a relationship between the back contrast and a degree of generation of the fog. In FIG. 5, the abscissa represents the back contrast and the ordinate represents a value of reflection density of white paper measured by a reflection density meter ("TC-6DS/A30", manufactured by Tokyo Denshoku Co., Ltd.) in the case where a solid white image is printed (sheet passing) on the white paper. A unit of the reflection density is %, and a large value represents that the fog generates in a large amount. As shown in FIG. 5, the back contrast has an optimum value, and even when the back contrast is excessively small or excessively large, a minimum value of the fog cannot be obtained. In general, during image formation, the back contrast is set so that the amount of the fog is the minimum value.

Figure 6:
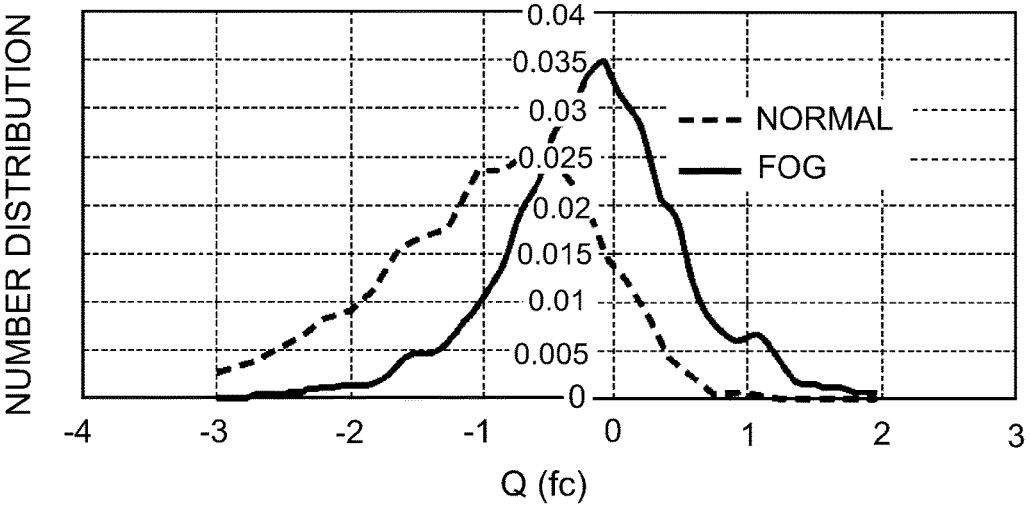
FIG. 6 is a graph for illustrating electric charges of toner on the photosensitive drum.

FIG. 6 is a graph showing an electric charge distribution of the toner deposited on the photosensitive drum 1, in which the toner deposited on a normal light potential portion (printing portion) and the toner causing a "sandpaper-like fog" described later are compared with each other. In FIG. 6, the abscissa represents the electric charge and the ordinate represents a value of a number distribution measured using a measuring device ("Espart analyzer model EST-III-cs", manufactured by Hosokawa Micron Corp.). In the case where the back contrast is smaller than an optimum value, the toner moving from the developing sleeve 41 to the photosensitive drum 1 has a high ratio of the toner with a small absolute value of the electric charge compared with the toner moving from the developing sleeve 41 to the normal light potential portion. Thus, a phenomenon that in the case where the back contrast is smaller than the optimum value, the toner deposits on the dark potential portion is referred to as the background fog. On the other hand, the back contrast is larger than the optimum value, the toner moving from the developing sleeve 41 to the photosensitive drum 1 has a high ratio of the toner having the electric charge of an opposite polarity to the normal charge polarity compared with the toner moving from the developing sleeve 41 to the normal light potential portion. Thus, a phenomenon that in the case where the back contrast is larger than the optimum value, the toner deposits on the dark potential portion is referred to as a "reverse charge fog".

When charging non-uniformity (potential non-uniformity of the dark potential portion) of the photosensitive drum 1 generates due to the small Vpp of the charging AC as described above, the toner deposits on the surface of the photosensitive drum 1 in a region where the back contrast is microscopically smaller than the optimum value, so that the fog generates. This phenomenon is referred to as the "sandpaper-like fog" is a kind of the "background fog", and the toner caused the "sandpaper-like fog" has a high ratio of the toner with a small absolute value of the electric charge compared with the toner depositing on the normal light potential portion. According to study by the present inventor, in order to sufficiently reduce the "sandpaper-like fog" to a degree such that the "sandpaper-like fog" cannot be observed by eyes, there is a need to set the Vpp of the charging AC at a value larger than 2Vth+200 V. In other words, by setting the Vpp of the charging AC in a range satisfying the following formula:

$$2Vth \leq Vpp \leq 2Vth + 200\ V,$$

the sandpaper-like fog can be positively generated.

7. Supplying Operation

As described above, when the photosensitive drum 1 is continuously rotated in a state in which the amount of the toner supplied to the photosensitive drum 1 is small, the frictional force between the photosensitive drum 1 and the cleaning blade 61 increases. Then, in some cases, the cleaning blade 61 causes the shuddering and the turning-up. In order to suppress the "shuddering" and the "turning-up" of the cleaning blade 61, execution of the supplying operation (purging) in which the frictional force between the photosensitive drum 1 and the cleaning blade 61 is reduced by supplying the toner to the cleaning position d during non-image formation is effective.

However, as described above, when a normal print pattern (solid black image or thin line image) is formed on the photosensitive drum 1 in the supplying operation, in some cases, improper cleaning generates due to slip-through of the toner itself of the print pattern.

According to study by the present inventor, it turned out that a degree of generation of the slip-through was influenced by an electric charge amount of the toner. An absolute value of the electric charge of the toner supplied to the cleaning position d by the supplying operation may preferable be smaller. That is, the toner having a relatively small absolute value of the electric charge is relatively small in mirror force, while the photosensitive drum 1 and the toner having a relatively large absolute value of the electric charge is relatively large in mirror force with the photosensitive drum 1. The toner having the relatively large absolute value of the electric charge is high in mirror force, and therefore, in the supplying operation, the toner is liable to slip (pass) through the cleaning blade 61 without being scraped off by the cleaning blade 61. For that reason, in the supplying operation, when the toner of a normal print pattern with a high ratio of the toner having the relatively high absolute value of the electric charge is supplied to the cleaning position d, the toner slips through the cleaning blade 61, so that the improper cleaning is liable to occur. On the other hand, the toner having the relatively small absolute value of the electric charge is relatively low in mirror force, and therefore, is easily scraped off by the cleaning blade 61.

Therefore, in this embodiment, in the supplying operation, the above-described "sandpaper-like fog" in which the toner with a high ratio of the toner having the relatively small absolute value of the electric charge deposits on the dark potential portion is positively generated, and the toner caused the sandpaper-like fog is supplied to the cleaning position d. Specifically, the Vpp of the charging AC in the supplying operation is sufficiently decreased and thus the potential leveling effect is lowered, so that the sandpaper-like fog is positively generated. The toner causing the sandpaper-like fog is relatively small in absolute value of the electric charge and is relatively low in mirror force, and therefore, is easily scraped off by the cleaning blade 61 and stagnates at a free end of the cleaning blade 61 on a free end portion side of the cleaning blade 61. As a result, a lubricating property is imparted to between the photosensitive drum 1 and the cleaning blade 61, whereby not only the "shuddering" and the "turning-up" of the cleaning blade 61 can be suppressed but also the improper cleaning due to the slip of the toner through the cleaning blade 61 can be suppressed.

Further, there is a correlation between the Vpp of the charging AC and a cleaning property, so that the cleaning property is improved when the Vpp of the charging AC is small. That is, in the case where the AC charging type is used, the slip-through is liable to occur by physically vibrating the photosensitive drum 1 based on electrical vibration. On the other hand, in the supplying operation, the Vpp of the charging AC is sufficiently decreases, so that a lowering in cleaning property due to the vibration as described above can be suppressed.

That is, in the supplying operation, by making the Vpp of the charging AC sufficiently small, not only the toner having the relatively small absolute value of the electric charge can be supplied to the cleaning position d by the sandpaper-like fog, but also the improper cleaning can be suppressed also by decreasing a degree of the vibration.

As described above, in order to positively generate the sandpaper-like fog, the Vpp of the charging AC is set in the range satisfying the following relationship:

$$2Vth \leq Vpp \leq 2Vth + 200\ V.$$

Incidentally, the Vpp may preferably be not more than 2Vth+100 V.

That is, in this embodiment, the controller 50 is capable of executing, during non-image formation, the supplying operation for supplying the toner to the cleaning position d by moving the toner from the developing sleeve 41 to a predetermined region on the photosensitive drum 1. In the supplying operation, the controller 50 causes the voltage sources to apply the charging bias to the charging roller 2 when the predetermined region passes through the charging position a and to apply the developing bias to the developing sleeve 41 when the predetermined region passes through the developing position c. Here, the Vpp of the charging AC when the predetermined region passes through the charging position a is referred to as "Vpp1", the Vpp of the charging AC during image formation is referred to "Vpp2", and a discharge start voltage between the photosensitive drum 1 and the charging roller 2 is referred to as "2Vth". In this case, the controller 50 carries out control in the supplying operation so as to satisfy the following relationships:

$$Vpp1 > Vpp2, \text{ and}$$

$$2Vth \leq Vpp \leq 2Vth + 200\ V.$$

7-2. Setting of Charging Bias and Developing Bias

Setting of the charging bias and the developing bias during image formation and during supplying operation in this embodiment is as follows.

<Setting During Image Formation>

(Charging bias)

DC component: −400 V

AC component: Vpp=1500 V ("Vpp2", f (frequency)=1.5 kHz, sine wave)

(Developing bias)

DC component: −300 V

AC component: Vpp=1800 V, f=2.5 kHz, sine wave

In this setting, the sandpaper-like fog is suppressed to a reflection density of about 1% which is substantially negligible.

<Setting During Supplying Operation>

(Charging Bias)

DC component: −400 V (same as during image formation)

AC component: Vpp=1200 V ("Vpp1"), f=1.5 kHz, sine wave) (Developing bias)

DC component: −300 V (same as during image formation)

AC component: Vpp=1800 V, f=2.5 kHz, sine wave (same as during image formation)

In this setting, the sandpaper-like fog with a reflection density of about 8% generates. In the supplying operation, a time in which the toner is deposited on the photosensitive drum 1 is 200 msec, a toner deposition width on the photosensitive drum 1 with respect to the rotational direction of the photosensitive drum 1 is 40 mm, and a toner deposition amount on the photosensitive drum 1 is 12 mg. Incidentally, in the supplying operation, the toner caused the sandpaper-like fog deposits in a substantially entirety of an image formable region of the photosensitive drum 1 with respect to the rotational axis direction of the photosensitive drum 1.

7-3. Control of Execution of Supplying Operation

In this embodiment, the supplying operation is executed in a pre-rotation step of a subsequent job after a rotation distance of the photosensitive drum 1 reaches a rotation distance of the photosensitive drum 1 corresponding to that in the case where printing of 100 sheets on a letter size basis is continuously carried out.

Figure 7:
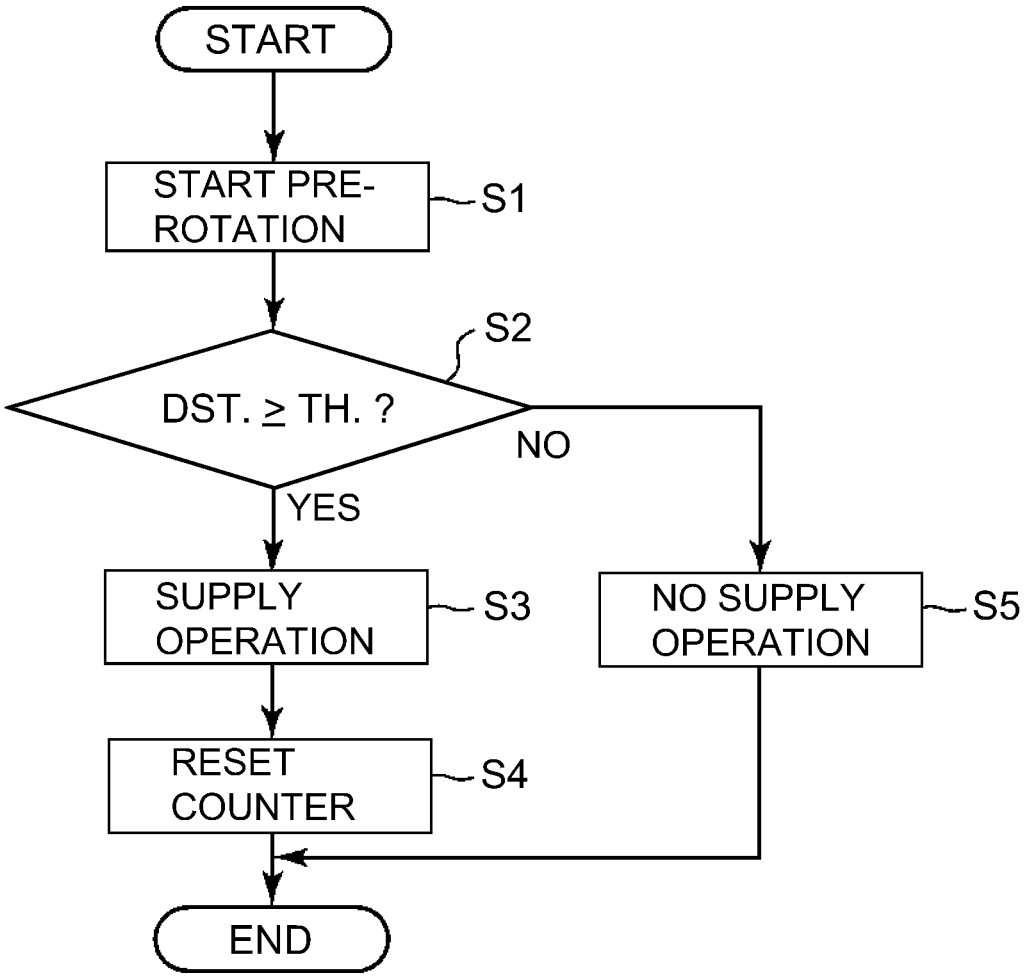
FIG. 7 is a flowchart of an example of control for discriminating execution or non-execution of a control.

FIG. 7 is a flowchart showing an outline of a procedure of control for discriminating whether or not the supplying operation in this embodiment should be executed. When a start of a job is instructed, the controller 50 causes the image forming apparatus to start a pre-rotation step (S1). Then, the controller 50 discriminates whether or not the rotation distance, from execution of the last supplying operation, read from the rotation distance counter 11 is not less than the rotation distance, as a threshold, corresponding to the continuous printing of 100 sheets on the letter size basis (S2). Then, in the case where the controller 50 discriminated that the rotation distance is not less than the threshold in S2 ("YES"), the controller 50 determines execution of the supplying operation during the present pre-rotation step (S3), and resets a count value of the rotation distance counter 11 to zero (S4). On the other hand, in the case where the controller 50 discriminated that the rotation distance is less than the threshold (100 sheets) in S2 ("NO"), the controller 50 determines non-execution of the supplying operation during the present pre-rotation step (S5). Incidentally, thereafter, the controller 50 causes the image forming apparatus to start an image forming step as soon as a pre-rotation step including or not including the supplying operation depending on the discrimination in S2.

7-4. Sequence

Figure 8:
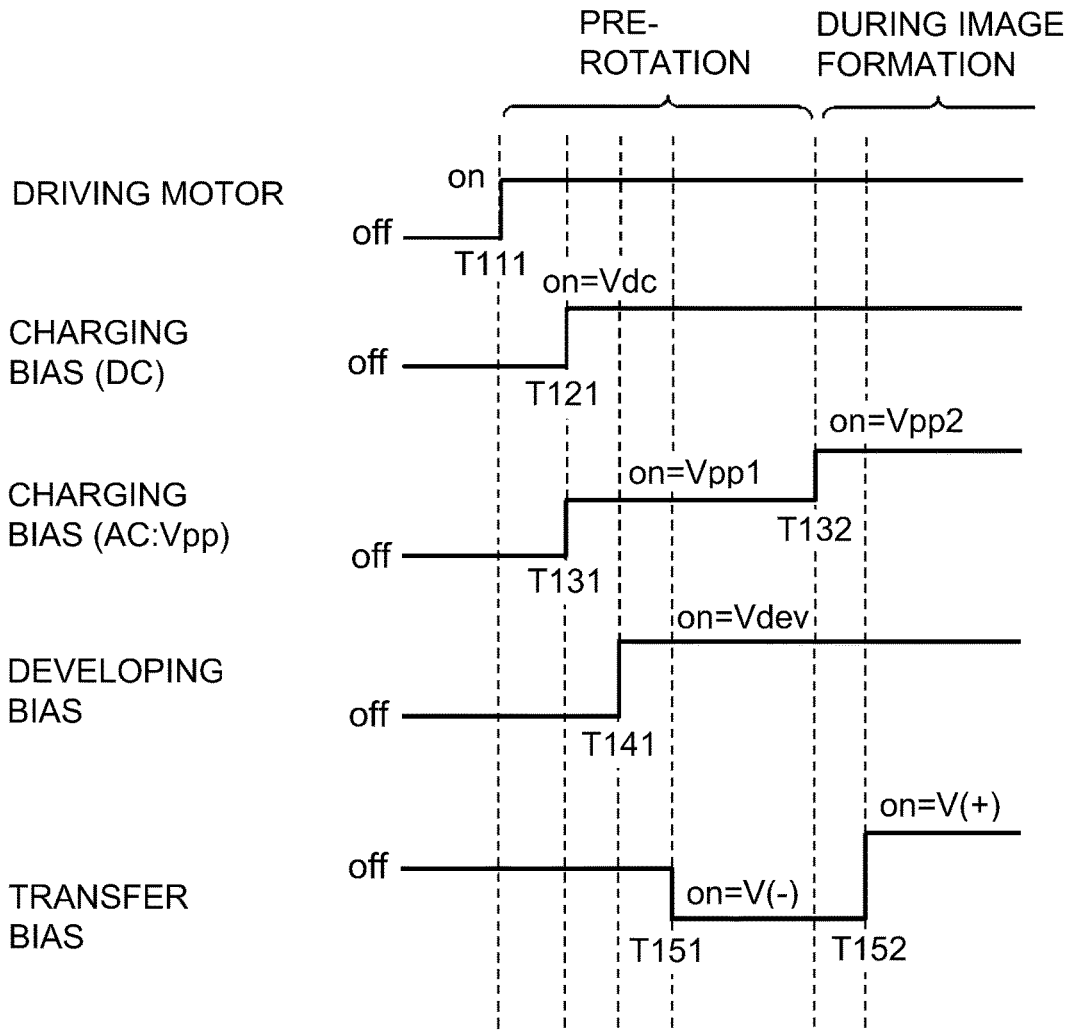
FIG. 8 is a sequence chart of an example of the supplying operation during a pre-rotation step.

FIG. 8 is a sequence chart showing an example of operation states of respective portions in the case where the supplying operation in this embodiment is executed.

When the pre-rotation step is started, first, drive of the driving motor M1 is started (T111). Then, application of the charging DC and the charging AC is started (T121, T131). At this time, the Vpp of the charging AC is set at "Vpp1", and the charging DC is set at a value equal to the value during image formation. Then, application of the developing DC and the developing AC (in FIG. 8, only the developing DC is shown) is started in synchronism with timing when the position of the photosensitive drum 1 which is the charging position a when the application of "Vpp1" is started reaches the developing position c (T141). As a result, the sandpaper-like fog generates, and the toner deposits on the photosensitive drum 1. Then, application of the transfer bias of the negative polarity (−500 V in this embodiment) is started in synchronism with timing when the position (the toner caused sandpaper-like fog) of the photosensitive drum 1 which is the charging position a when the application of "Vpp1" is started reaches the transfer position N (T151). This is for the following reason. That is, the toner caused the sandpaper-like fog is high in ratio of the negatively charged toner having the relatively small absolute value of the electric charge. For that reason, by applying the transfer bias of the same polarity (which is an opposite polarity to the polarity of the transfer bias during image formation) as this toner, the toner in an amount as large as possible is repelled from the transfer roller 5 (i.e., the toner is urged toward the photosensitive drum 1) and thus is supplied to the cleaning position d.

Then, at timing when and after the predetermined region where the sandpaper-like fog should be generated on the photosensitive drum 1 passes through the charging position a, the Vpp of the charging AC is switched from "Vpp1" to "Vpp2", and the sequence goes to the image forming step (T132). Thereafter, application of the transfer bias of the positive polarity (+1500 V in this embodiment) is started in synchronism with timing when the position of the photosensitive drum 1 which is the charging position a at the time when the Vpp of the charging AC is switched from "Vpp1" to "Vpp2" reaches the transfer position N (T152).

Figure 14:
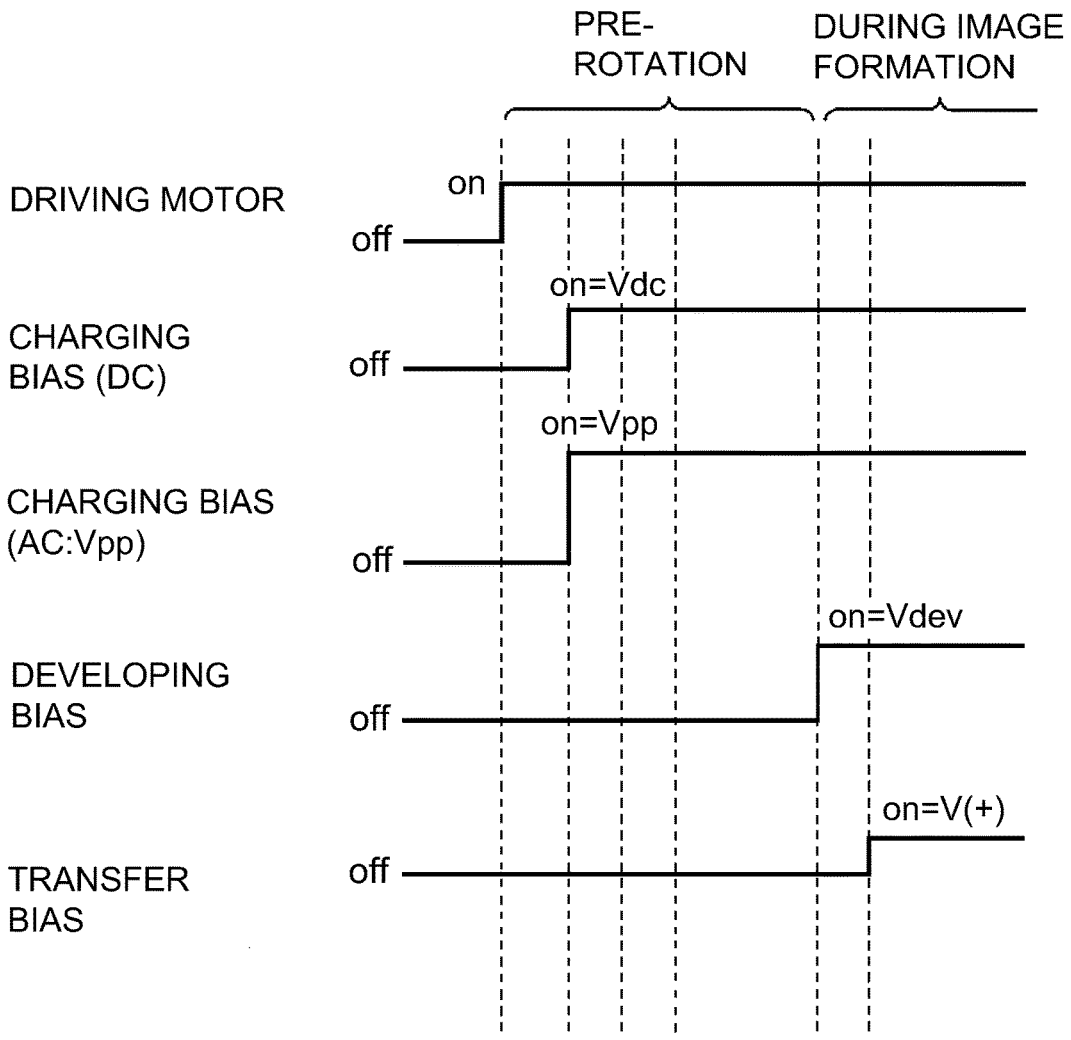
FIG. 14 is a sequence chart of a pre-rotation step in the case where the supplying operation is not performed.

Incidentally, FIG. 14 is a sequence chart showing an example of operation states of the respective portions in the case where the supplying operation is not executed.

7-5. Effect

A degree of occurrence of the improper cleaning was compared between this embodiment and the case (comparison example) where in the supplying operation, the toner of the normal print pattern is supplied to the cleaning position d. In the comparison example, in the supplying operation, a band-like solid black image is formed sufficiently over an entirety of the image formable region of the photosensitive drum 1 with respect to the rotational axis direction, so that the toner in an amount equal to the amount of the toner in this embodiment was deposited on the photosensitive drum 1. A constitution and an operation of an image forming apparatus of the comparison example are sufficiently the same as those of the image forming apparatus 100 of this embodiment except for the above-described point. The improper cleaning (slip-through) was observed by eyes, and was evaluated as x (improper) in the case where the improper cleaning occurred to a non-negligible level and was evaluated as o (good) in the case where the improper cleaning did not occur or occurred to a negligible level. An evaluation result is shown in Table 1. Further, in this embodiment and the comparison example, a durability test ($30\times10^3$ sheets) was conducted, and occurrence or non-occurrence of the "shuddering" and the "turning-up" was checked.

TABLE 1

(during supplying operation)

| Kind of toner | Toner amount | Slip-through |
|---|---|---|
| SBI (CE)*1 | 12 mg | x |
| SLF (EMB.1)*2 | 12 mg | o |

*1"SBI (CE)" is the solid black image (comparison example).
*2"SLF (EMB.1)" is the sandpaper-like fog (Embodiment 1).

In either of this embodiment and the comparison example, it turned out that the "shuddering" and the "turning-up" can be sufficiently suppressed. However, as shown in Table 1, in the comparison example, the slip-through occurred. On the other hand, in this embodiment, the slip-through did not occur.

Further, when a similar test in which the Vpp of the charging AC in this embodiment was changed was conducted, in some cases, the improper cleaning due to the "shuddering" occurred when the Vpp exceeded 1300 V (i.e., 2Vth+200 V). This would be considered because the sandpaper-like fog cannot be sufficiently generated and thus the toner in a sufficient amount cannot be supplied to the cleaning position d.

As described above, according to this embodiment, in the case where the AC charging type is used, not only the toner can be sufficiently supplied to the contact portion between the photosensitive drum 1 and the cleaning blade 61 during non-image formation but also the occurrence of the improper cleaning can be suppressed by the toner.

Embodiment 2

Next, another embodiment of the present invention will be described. Basic constitution and operation of an image forming apparatus 100 of this embodiment are similar to those of the image forming apparatus 100 of Embodiment 1. Accordingly, elements having identical or corresponding functions of constitutions to those of the image forming apparatus of Embodiment 1 are represented by the same reference numerals or symbols as those in Embodiment 1 and will be omitted from detailed description.

1. Supplying Operation in this Embodiment

In this embodiment, an average print ratio is counted (as 0% during non-image formation) every rotation distance of the photosensitive drum 1 corresponding to the rotation distance in the case where printing on 100 sheets on the letter size basis was continuously carried out. This average print ratio can be acquired by integrating the number of pixels during image formation and then by calculating a proportion (%) of an integrated value to the number of all of the pixels, in the image formable region, corresponding to the rotation distance of the photosensitive drum 1 up to this time. Then, in this embodiment, in the pre-rotation step of a subsequent job after the rotation distance of the photosensitive drum 1 reaches the rotation distance corresponding to the above-described continuous printing of 100 sheets, in the case where the average print ratio is not more than a threshold, the supplying operation is executed.

Here, the print ratio during image formation fluctuates depending on the image to be printed. Further, a time in which there is no toner supply to the photosensitive drum 1, for example, a time of the pre-rotation step is not a certain time. For example, the time of the pre-rotation step becomes long in the following case. For example, the case where it takes much time to develop an image can be cited. Further, in a constitution in which the driving motor is common to the stirring member of the developing device and the photosensitive drum, the case where the developer in the developing device is stirred for a time longer than a time of a normal operation can be cited. Further, in a constitution in which the driving motor is common to the fixing device and the photosensitive drum, the case where temperature rise of the fixing device requires a time longer than a time of a normal operation can be cited. For that reason, the supplying operation can be performed at more proper timing by discriminating whether or not the supplying operation should be executed, on the basis of the average print ratio is consideration of also the rotation distance of the photosensitive drum 1 during non-image formation as described above.

Further, in this embodiment, the threshold of the above-described average print ratio is changed depending on an ambient temperature. In the case of a relatively low temperature, the cleaning blade 61 becomes relatively hard, so that the frictional force between the photosensitive drum 1 and the cleaning blade 61 increases, and thus the "shuddering" and the "tuning-up" are liable to occur. For that reason, the threshold of the average print ratio is changed to a larger value with a lower temperature environment.

Referring to FIG. 3, in this embodiment, the print ratio counter (storing means) 12 as a counting means is connected to the controller 50. The controller 50 causes the print ratio counter 12 to store the average print ratio calculated as described above. Further, in this embodiment, to the controller 50, the temperature sensor 13 for detecting a temperature of the inside portion of the apparatus main assembly 100, as a temperature detecting means for detecting at least one of temperatures of the inside portion and the outside portion of the apparatus main assembly 110 is connected. A signal indicating a detection result of the temperature sensor 13 is inputted into the controller 50.

In this embodiment, setting of the charging bias and the developing bias during image formation and during the supplying operation and setting of the amount (time, width, weight) of the toner deposited on the photosensitive drum 1 in the supplying operation are the same as those in Embodiment 1. Further, in this embodiment, operations of the respective portions in the case where the supplying operation is executed are in accordance with the sequence chart of FIG. 8 similarly as in Embodiment 1. On the other hand, in this embodiment, operations of the respective portions in the case where the supplying operation is not executed is in accordance with a sequence chart of FIG. 14.

Figure 9:
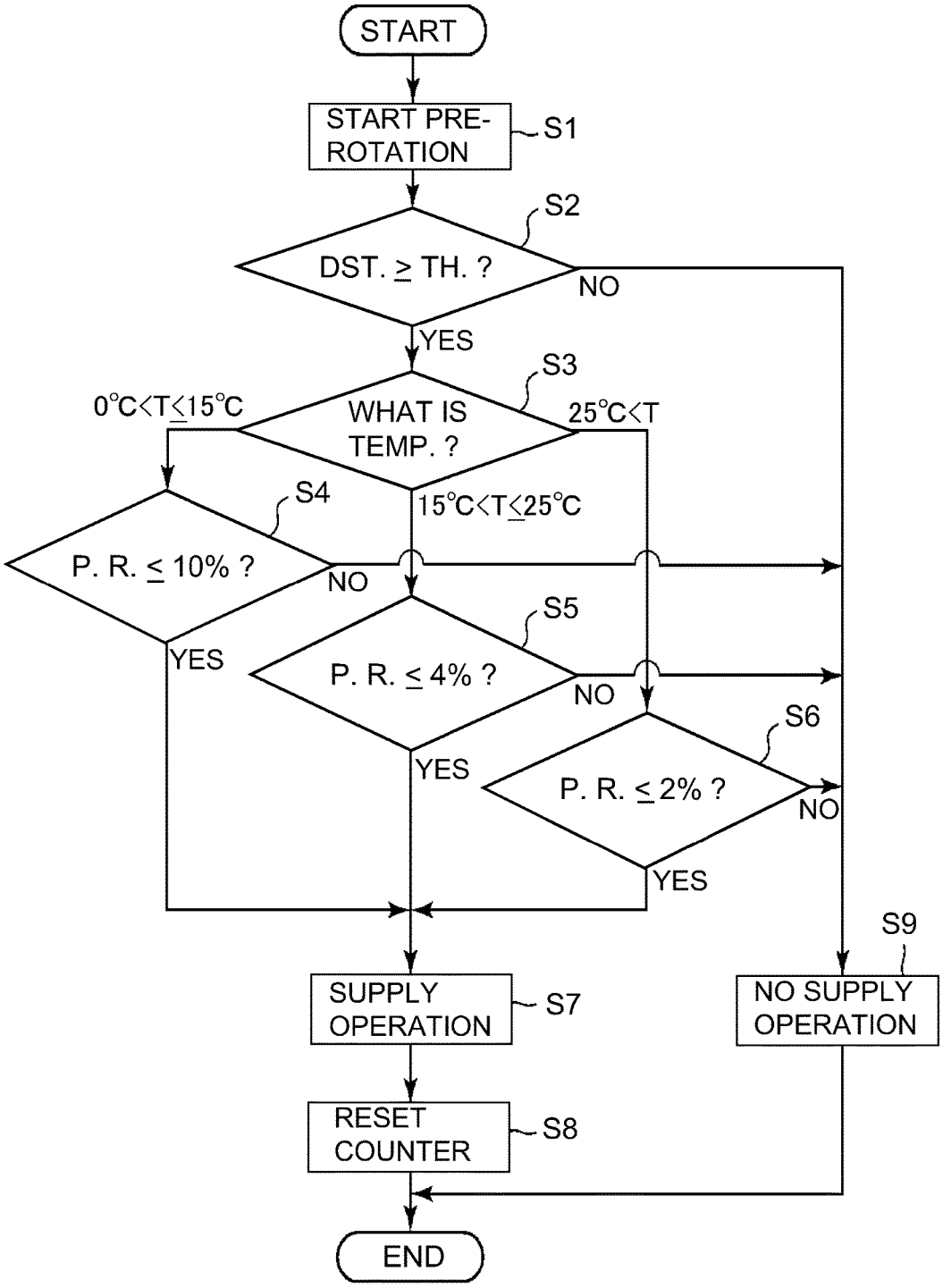
FIG. 9 is a flowchart of another example of the control for discriminating execution or non-execution of the supplying operation.

FIG. 9 is a flowchart showing an outline of a procedure of control for discriminating whether or not the supplying operation in this embodiment should be executed. When a start of a job is instructed, the controller 50 causes the image forming apparatus to start a pre-rotation step (S1). Then, the controller 50 discriminates whether or not the rotation distance, from execution of the last supplying operation, read from the rotation distance counter 11 is not less than the rotation distance, as a threshold, corresponding to the continuous printing of 100 sheets on the letter size basis (S2). Then, in the case where the controller 50 discriminated in S2 that the rotation distance was not less than the threshold ("YES"), the controller 50 discriminates whether a temperature X in the image forming apparatus read from the temperature sensor 13 is either one of a low temperature (0° C.<X≤15° C.), a normal temperature (15° C.<X≤25° C.) and a high temperature (25° C.<X) (S3). Then, in the case where the controller 50 discriminated in S3 that the temperature X was the low temperature, the controller 50 discriminates whether or not the average print ratio, from the execution of the last supplying operation, read from the print ratio counter 12 is not more than 10% as a first threshold (S4). In the case where the controller 50 discriminated in S3 that the temperature X was the normal temperature, the controller 50 discriminates whether or not the average print ratio, from the execution of the last supplying operation, read from the print ratio counter 12 is not more than 4% as a second threshold (S5). In the case where the controller 50 discriminated in S3 that the temperature X was the high temperature, the controller 50 discriminates whether or not the average print ratio, from the execution of the last supplying operation, read from the print ratio counter 12 is not more than 2% as a third threshold (S6).

Then, in the case where the controller 50 discriminated that the print ratio is not more than the threshold in S4, S5 and S6 ("YES"), the controller 50 determines execution of the supplying operation during the present pre-rotation step (S7), and resets count values of the print number counter 11 and the print ratio counter 12 to zero (S8). On the other hand, in the case where the controller 50 discriminated that the rotation distance is less than the threshold in S2 ("NO") or discriminated that the print ratio is more than the threshold in S4, S5 and S6 ("NO"), the controller 50 determines non-execution of the supplying operation during the present pre-rotation step (S9).

A total toner consumption amount of the supplying operation until the process cartridge 7 reaches an end of its lifetime in the case where printing of $30\times10^3$ sheets was carried out in a one-sheet intermittent state in an environment of 20° C. under a condition that the print ratio was changed is as follows. Incidentally, the one-sheet intermittent state is an operational state such that a job in which the pre-rotation step, the image forming step and the post-rotation step are performed is repeated every printing of one sheet. In the case where the print ratio is 5%, the supplying operation is not regarded as being needed, so that there is no toner consumption by the supplying operation. On the other hand, in the case where the print ratio is 1%, 3600 mg of the toner is consumed by the supplying operation.

Thus, according to this embodiment, by executing the supplying operation at proper timing as needed, the toner can be saved while ensuring a good cleaning performance.

2. Modified Embodiment

A modified embodiment of the control for discriminating occurrence or non-occurrence of the execution of the supplying operation will be described. In the case where an index value correlating with the frictional force between the photosensitive drum 1 and the cleaning blade 61 satisfies a predetermined condition, the controller 50 is capable of executing the supplying operation during non-image formation.

For example, in Embodiment 1, the supplying operation was executed during non-image formation in the case where the count result of the rotation distance as an index value correlating with the movement distance of the photosensitive drum 1 with respect to the rotational direction is not less than the threshold. As described above, the frictional force between the photosensitive drum 1 and the cleaning blade 61 increases by rotating the photosensitive drum 1 in a state in which an amount of the toner supplied to the photosensitive drum 1 is small. For that reason, in the case where the count result of the rotation distance, by the rotation distance counter 11, as the index value correlating with the movement distance of the photosensitive drum 1 in the rotational direction during non-image formation is not less than the threshold, the supplying operation may also be executed during non-image formation.

Further, in the case where the occurrence or non-occurrence of the execution of the supplying operation is discriminated depending on the rotation distance of the photosensitive drum 1 as in Embodiment 1, the threshold of the rotation distance can be changed depending on the ambient temperature similarly as in this embodiment. In this case, the controller 50 changes the threshold so as to be larger in the case of a second temperature higher than a first temperature than in the case of the first temperature. This is because as described above, in the case where the ambient temperature is a relatively low temperature, the frictional force between the photosensitive drum 1 and the cleaning blade 61 is liable to increase. As another method, the threshold of the rotation distance can be changed depending on a use amount of the developing device 4. As an index value correlating with the use amount of the developing device 4, it is possible to use arbitrary values such as the number of times of rotation and a rotation time of the developing sleeve 41, the number of times of rotation and a rotation time of the stirring member 45, and the print number. In this case, the image forming apparatus may only be required to be provided with a counter (storing portion) as a use amount counting means for counting the index value. Further, in this embodiment, the controller 50 changes the threshold so as to be smaller in the case of a second value larger than a first value than in the case of the first value. This is because flowability of the developer lowers with consumption of the developing device 4 and thus a lubricating property imparted to between the photosensitive drum 1 and the cleaning blade 61 is liable to lower during the supplying operation.

The index value correlating the movement distance of the photosensitive drum 1 in the rotational direction is not limited to the rotation distance of the photosensitive drum 1, but may also be the number of times of rotation, the rotation time, or the like. Further, depending on a desired degree or the like of the suppression of the "shuddering" and the "turning-up", for example, the print number (the print number on a predetermined size conversion basis) may also be used.

Further, in this embodiment, in the case where the count result of the average print ratio as the index value correlating with the amount of the toner supplied to the photosensitive drum 1 during movement of the photosensitive drum 1 in the rotational direction by a predetermined distance is not more than the threshold, the supplying operation was executed during non-image formation. Further, the threshold of the average print ratio was changed depending on the ambient temperature. At this time, the controller 50 changes the threshold so as to be smaller in the case of a second temperature higher than a first temperature than in the case of the first temperature. This is because as described above, in the case where the ambient temperature is a relatively low temperature, the frictional force between the photosensitive drum 1 and the cleaning blade 61 is liable to increase. As another method, the threshold of the average print ratio can be changed depending on a use amount of the developing device 4 similarly as described above. In this embodiment, the controller 50 changes the threshold so as to be larger in the case of a second value larger than a first value than in the case of the first value. This is because as described above, flowability of the developer lowers with consumption of the developing device 4 and thus a lubricating property imparted to between the photosensitive drum 1 and the cleaning blade 61 is liable to lower during the supplying operation.

Further, for example, at predetermined timing such as every pre-rotation step, the occurrence or non-occurrence of the execution of the supplying operation may also be discriminated on the basis of the ambient temperature or the use amount of the developing device 4. In the case where the discrimination is made on the basis of the ambient temperature, when the ambient temperature is not more than a threshold, the controller 50 executes the supplying operation during non-image formation. Further, in the case where the discrimination is made on the basis of the use amount of the developing device 4, when the count result of the use amount is not less than a threshold, the controller 50 can carry out control so that the supplying operation is executed during non-image formation.

Embodiment 3

Next, another embodiment of the present invention will be described. Basic constitution and operation of an image forming apparatus 100 of this embodiment are similar to those of the image forming apparatus 100 of Embodiment 1. Accordingly, elements having identical or corresponding functions of constitutions to those of the image forming apparatus of Embodiment 1 are represented by the same reference numerals or symbols as those in Embodiment 1 and will be omitted from detailed description.

In this embodiment, in the case where a rotation torque of the driving motor M1 of the photosensitive drum 1 is not less than a threshold in the pre-rotation step, the controller 50 rotates so that the lubricating property between the photosensitive drum 1 and the cleaning blade 61 lowers, and decreases the Vpp of the charging AC, so that the sandpaper-like fog is positively generated. Further, as a result of the positive generation of the sandpaper-like fog, in the case where the rotation torque lowers to a value less than the threshold in the pre-rotation step, the controller 50 increases the Vpp of the charging AC again. Thus, by executing the supplying operation at timing when the lubricating property between the photosensitive drum 1 and the cleaning blade 61 is actually impaired, the amount of consumption of the toner by the supplying operation can be reduced.

That is, the controller 50 is capable of switching the Vpp of the charging AC during non-image formation. Here, the Vpp of the charging AC when a region different from the predetermined region where the sandpaper-like fog is generated on the photosensitive drum 1 during non-image formation passes through the charging position a is referred to as "Vpp3". In this case, the controller 50 carries out control the switching of the Vpp3 so as to satisfy the following relationship:

$$V_{pp1} < V_{pp3}.$$

As described in Embodiment 1, "Vpp1" is setting for positively generating the sandpaper-like fog and for supplying the toner to the cleaning position d. "Vpp2" is setting for suppressing the sandpaper-like fog to a negligible level and for carrying out substantially uniform charging with no improper cleaning. "Vpp3" is setting for suppressing the sandpaper-like fog to the negligible level and for suppressing abrasion of the surface of the photosensitive drum 1 while permitting somewhat generation of the improper cleaning.

Incidentally, in this embodiment, similarly as in Embodiment 1, the developing bias is applied when the region of the photosensitive drum 1 passed through the charging position a under application of "Vpp1" passes through the developing position c, and the transfer bias of an opposite polarity to the polarity during image formation is applied when the region of the photosensitive drum 1 passes through the charging position a under application of "Vpp1" passes through the developing position c. On the other hand, in this embodiment, the application of the developing bias is stopped when the region of the photosensitive drum 1 passed through the charging position a under application of "Vpp3" passes through the developing position c, and the application of the transfer bias of an opposite polarity to the polarity during image formation is stopped when the region of the photosensitive drum 1 passes through the charging position a under application of "Vpp1" passes through the developing position c. That is, the toner is not positively supplied to the region of the photosensitive drum 1 passing through the charging position a under application of "Vpp3".

Referring to FIG. 3, in this embodiment, to the controller 50, a torque gage 14 as a torque detecting means incorporated in the driving motor M1 of the photosensitive drum 1 is connected. A signal indicating a detection result of the torque gauge 14 is inputted to the controller 50.

Setting of the charging bias and the developing bias during image formation and during pre-rotation step in this embodiment is as follows.

<Setting During Image Formation>

(Charging Bias)

DC component: −400 V

AC component: Vpp=1500 V ("Vpp2", f (frequency)=1.5 kHz, sine wave)

(Developing Bias)

DC component: −300 V

AC component: Vpp=1800 V, f=2.5 kHz, sine wave

<Setting During Supplying Pre-Rotation Step>

(Charging Bias)

DC component: −400 V (same as during image formation)

AC component: Vpp (other than during supplying operation=1400 V ("Vpp3"), Vpp (during supplying operation) =1200 V ("Vpp1"), f=1.5 kHz, sine wave)

(Developing Bias)

DC component: −300 V (same as during image formation)

AC component: Vpp=1800 V, f=2.5 kHz, sine wave (same as during image formation)

In this embodiment, in the case where a value of the rotation torque of the driving motor M1 is not less than 5 kgcm which is a threshold during pre-rotation step, the lubricating property between the photosensitive drum 1 and the cleaning blade 61 is regarded as being lowered, and the Vpp of the charging AC is set at "Vpp1". As a result, the sandpaper-like fog with the reflection density of about 8% generates. Further, in the case where the value of the rotation torque of the driving motor M1 is less than 5 kgcm which is the threshold during pre-rotation step, the lubricating property between the photosensitive drum 1 and the cleaning blade 61 is regarded as being sufficient, and the Vpp of the charging AC is set at "Vpp3". In this setting, the amounts (time, width, weight) of the toner deposited on the photosensitive drum 1 by the supplying operation was about 200 msec, about 40 mm and about 12 mg.

Figure 10:
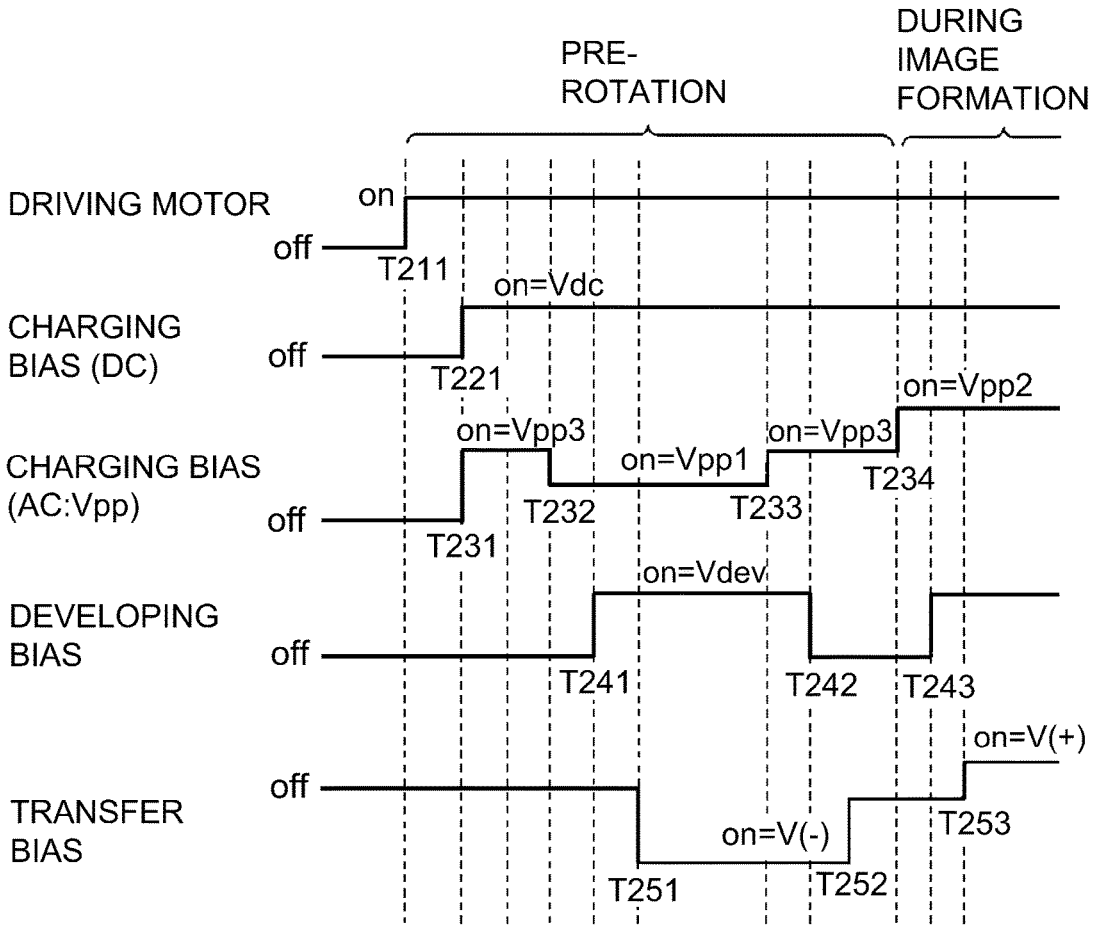
FIG. 10 is a sequence chart of another example of the supplying operation during the pre-rotation step.

FIG. 10 is a sequence chart showing an example of operation states of respective portions in the case where the supplying operation in this embodiment is executed. In this case, the pre-rotation step is performed for a time determined by a factor, other than the supplying operation, such as for the purpose of, for example, warming the fixing device 9 or of loosening the developer in the developing device 4.

When the pre-rotation step is started, first, drive of the driving motor M1 is started (T211). Then, application of the charging DC and the charging AC is started (T221, T231). At this time, the Vpp of the charging AC is set at "Vpp3", and the charging DC is set at a value equal to the value during image formation. Further, the pre-rotation step is continued while monitoring a detection result of the torque gauge 14 immediately after a start of the pre-rotation step. Then, the lubricating property between the photosensitive drum 1 and the cleaning blade 61 is gradually impaired, and at timing when the detection result of the torque gauge 14 is not less than 5 kgcm, the Vpp of the charging AC is switched from "Vpp3" to "Vpp1" (T232). Then, application of the developing DC and the developing AC (in FIG. 10, only the developing DC is shown) is started in synchronism with timing when the position of the photosensitive drum 1 which is the charging position a when the application of "Vpp1" is started reaches the developing position c (T241). Then, application of the transfer bias of the negative polarity (−500 V in this embodiment) is started in synchronism with timing when the position (the toner caused sandpaper-like fog) of the photosensitive drum 1 which is the charging position a when the application of "Vpp1" is started reaches the transfer position N (T251).

Then, the lubricating property between the photosensitive drum 1 and the cleaning blade 61 gradually restores to an original one, and at timing when the detection result of the torque gauge 14 is less than 5 kgcm, the Vpp of the charging AC is switched from "Vpp1" to "Vpp3" (T233). Then, application of the developing DC and the developing AC is stopped in synchronism with timing when the position of the photosensitive drum 1 which was the charging position a when the Vpp was switched to "Vpp3" reaches the developing position c (T242). Further, application of the transfer bias is stopped in synchronism with timing when the position of the photosensitive drum 1 which was the charging position a when the Vpp was switched to "Vpp3" reaches the transfer position N (T252).

Then, after an end of the pre-rotation step, the Vpp of the charging AC is switched from "Vpp3" to "Vpp2", and the sequence goes to the image forming step (T234). Then, application of the developing DC and the developing AC is started in synchronism with timing when the position of the photosensitive drum 1 which was the charging position a when the Vpp of the charging AC was switched to "Vpp2" reaches the developing position c (T243). Thereafter, application of the transfer bias of the positive polarity (+1500 V in this embodiment) is started in synchronism with timing when the position of the photosensitive drum 1 which was the charging position a at the time when the Vpp of the charging AC was switched from "Vpp1" to "Vpp2" reaches the transfer position N (T253).

Table 2 shows a difference in total toner consumption amount by the supplying operation until the process cartridge 7 reaches an end of its lifetime in the case where in an environment of 20° C., printing of $30\times10^3$ sheets was carried out with a one-sheet intermittent manner by the image forming apparatuses of Embodiment 1 and this embodiment (Embodiment 3).

TABLE 2

| (during supplying operation) | | | |
|---|---|---|---|
| KOT*1 | ST*2 | TA*3 | TCA*4 |
| SLF (EMB.1)*5 | ○ | 12 mg | 3600 mg |
| SDSLF (EMB.2)*6 | ○ | 6 mg | 1800 mg |

*1"KOT" is the kind of the toner.

*2"ST" is the slip-through.

*3"TA" is the toner amount.

*4"TCA" is the total consumption amount of the toner by the supplying operation until the end of the lifetime of the process cartridge.

*5"SLF (EMB.1)" is the sandpaper-like fog (Embodiment 1).

*6"SDSLF (EMB.3)" is the switching during sandpaper-like fog (Embodiment 3).

As shown in Table 2, in this embodiment, the amount of consumption of the toner by the supplying operation can be reduced compared with Embodiment 1. Incidentally, in this embodiment, similarly as described in Embodiment 1, the degree of occurrence of the improper cleaning (slip-through) and the degrees of occurrences of the "shuddering" and the "turning-up" were checked, with the result that the improper cleaning, and the "shuddering" and the "turning-up" were able to be sufficiently suppressed.

Thus, according to this embodiment, the toner can be saved while ensuring a good cleaning performance.

Incidentally, the torque detecting means may detect a value which is not limited to a torque value itself but which is an index value correlating with the rotation torque of the driving motor M1. The controller 50 may only be required so that in the case where a detection result of the index value is not less than a threshold, the supplying operation is executed during non-image formation.

Embodiment 4

Next, another embodiment of the present invention will be described. Basic constitution and operation of an image forming apparatus 100 of this embodiment are similar to those of the image forming apparatus 100 of Embodiment 1. Accordingly, elements having identical or corresponding functions of constitutions to those of the image forming apparatus of Embodiment 1 are represented by the same reference numerals or symbols as those in Embodiment 1 and will be omitted from detailed description.

In Embodiments 1 to 3, an example in which the supplying operation was executed during the pre-rotation step was described. In this embodiment, an example in which the supplying operation is executed during sheet interval step will be described.

In this embodiment, setting of the charging bias and the developing bias during image formation and during sheet interval step (during the supplying operation) and setting of the amount (time, width, weight) of the toner deposited on the photosensitive drum 1 in the supplying operation are the same as those in Embodiment 1.

In the case where a recording material P having a size smaller than a general-purpose size such as an A4 size or a letter size is used, a time of the sheet interval step is set at a long time in some cases. Incidentally, the time of the sheet interval step refers to a time required that a region between an image formable region of the photosensitive drum 1 for an image forming step and a subsequent image formable region of the photosensitive drum 1 for a subsequent image forming step passes through a predetermined position of the photosensitive drum 1 with respect to the rotational direction of the photosensitive drum 1. In such a case, a time in which the toner is not supplied to the photosensitive drum 1 is long, and therefore, the lubricating property between the photosensitive drum 1 and the cleaning blade 61 is liable to be impaired. Therefore, in this embodiment, the supplying operation is executed during sheet interval step in the case where the small-size recording material P is used as described above and in the case where double-side printing is carried out.

Figure 11:
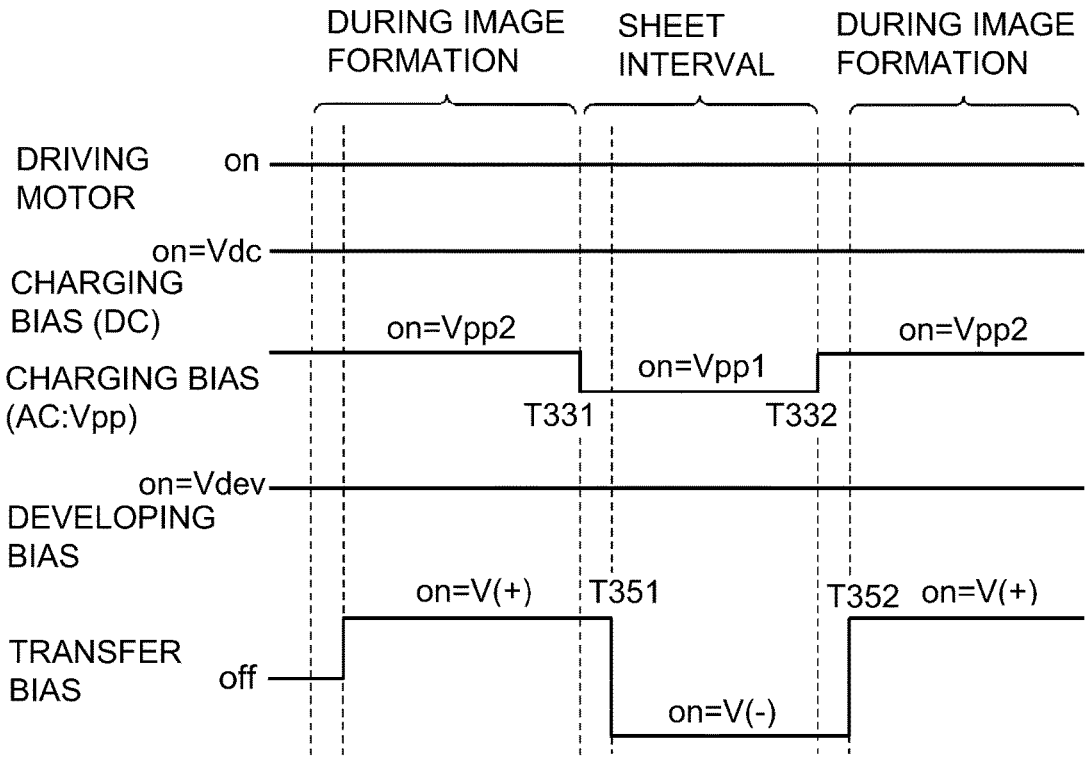
FIG. 11 is a sequence chart of an example of the supplying operation during a sheet interval.

FIG. 11 is a sequence chart showing an example of operational states of respective portions in the case where the supplying operation in this embodiment is executed.

The driving motor M1 is driven through the prior image forming step, the sheet interval step and the subsequent image forming step. Further, the discharge DC, and the developing DC and the developing AC (in FIG. 11, only the developing DC is shown) have the same values through the prior image forming step, the sheet interval step and the subsequent image forming step. The Vpp of the charging AC is switched from "Vpp2" to "Vpp1" at timing of a start of the sheet interval step (T331). Further, the polarity of the transfer bias is switched from the positive polarity to the negative polarity in synchronism with timing when the position (the toner caused sandpaper-like fog) of the photosensitive drum 1 which is the charging position a when the application of "Vpp1" is started reaches the transfer position N (T351). In this embodiment, the positive transfer bias is +1500 V, and the negative transfer bias is −500 V. Then, at timing when or after the predetermined region where the sandpaper-like fog should be generated on the photosensitive drum 1 passes through the charging position a during the sheet interval step, the Vpp of the charging AC is switched from "Vpp1" to "Vpp2" in preparation for the sequence goes to the image forming step (T332). Thereafter, the transfer bias is switched in polarity from the negative polarity to the positive polarity in synchronism with timing when the position of the photosensitive drum 1 which is the charging position a at the time when the Vpp of the charging AC is switched from "Vpp1" to "Vpp2" reaches the transfer position N (T352).

Incidentally, the method of discriminating the occurrence or non-occurrence of the execution of the supplying operation described in Embodiments 1 to 3 is arbitrarily applicable to also the case where the supplying operation is executed during the sheet interval step as in this embodiment.

Embodiment 5

Next, another embodiment of the present invention will be described. Basic constitution and operation of an image forming apparatus 100 of this embodiment are similar to those of the image forming apparatus 100 of Embodiment 1. Accordingly, elements having identical or corresponding functions of constitutions to those of the image forming apparatus of Embodiment 1 are represented by the same reference numerals or symbols as those in Embodiment 1 and will be omitted from detailed description.

In Embodiments 1 to 3, an example in which the supplying operation was executed during the pre-rotation step was described. In Embodiment 4, an example in which the supplying operation was executed during the sheet interval step was described. In this embodiment, an example in which the supplying operation is executed during the post-rotation step will be described.

In this embodiment, setting of the charging bias and the developing bias during image formation and during the post-rotation step (during the supplying operation) and setting of the amount (time, width, weight) of the toner deposited on the photosensitive drum 1 in the supplying operation are the same as those in Embodiment 1.

In this embodiment, the supplying operation is executed in a post-rotation step of a subsequent job after (typically immediately after) a rotation distance of the photosensitive drum 1 reaches a rotation distance of the photosensitive drum 1 corresponding to that in the case where printing of 100 sheets on a letter size basis is continuously carried out.

Figure 12:
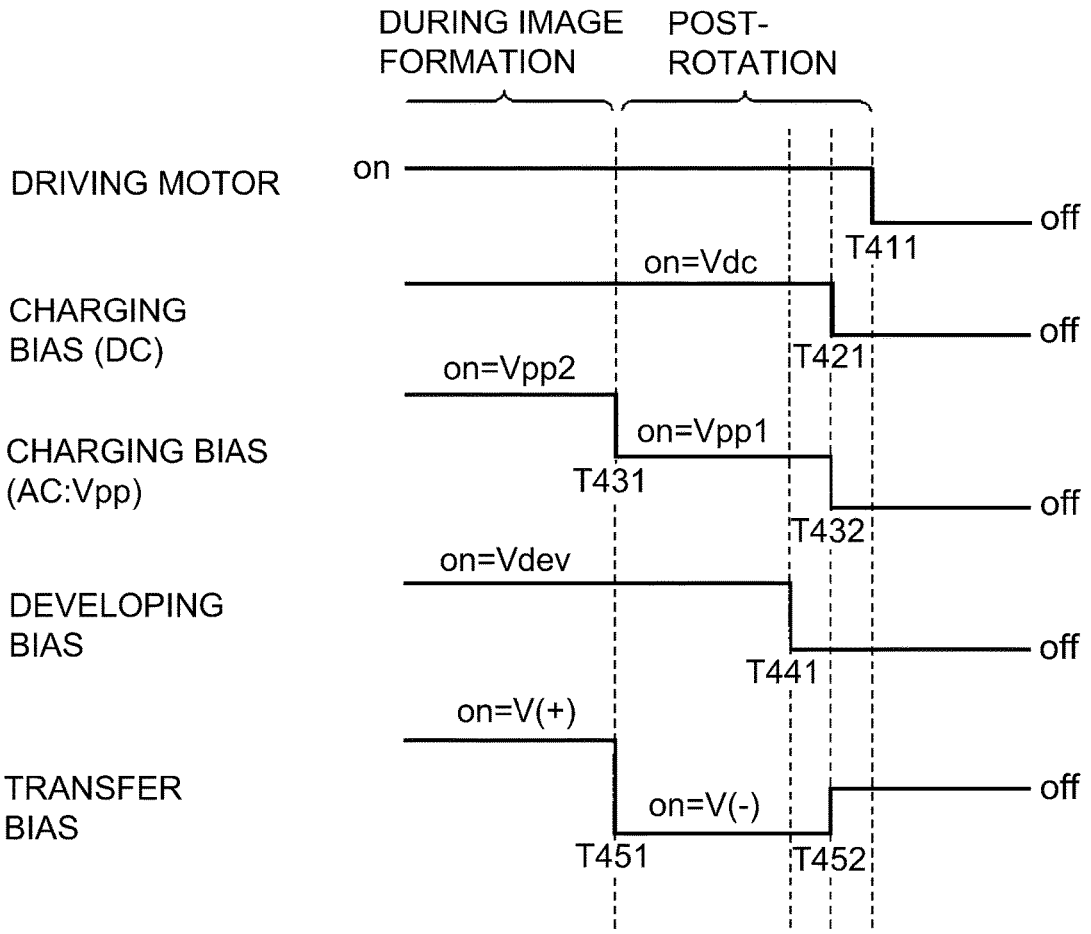
FIG. 12 is a sequence chart of an example of the supplying operation during a post-rotation step.

FIG. 12 is a sequence chart showing an example of operational states of respective portions in the case where the supplying operation in this embodiment is executed.

The driving motor M1 is driven during image formation. The Vpp of the charging AC is switched from "Vpp2" to "Vpp1" at timing of a start of the post-rotation step (T431). The discharge DC, and the developing DC and the developing AC (in FIG. 11, only the developing DC is shown) have the same values those during the image forming step. The transfer bias is switched in polarity from the positive polarity (+1500 V in this embodiment) to the negative polarity (−500 V in this embodiment) in synchronism with timing when application of "Vpp1" is started (T451). Then, the application of the developing DC and the developing AC is stopped at timing when and after the predetermined region where the sandpaper-like fog should be generated on the photosensitive drum 1 passes through the developing position c (T441). Then, not only the application of the charging DC and the charging AC is stopped (T421, T432) but also the application of the transfer bias is stopped (T452). Thereafter, drive of the driving motor M1 is stopped (T411).

Incidentally, the method of discriminating the occurrence or non-occurrence of the execution of the supplying operation described in Embodiments 1 to 3 is arbitrarily applicable to also the case where the supplying operation is executed during the post-rotation step as in this embodiment.

Embodiment 6

Next, another embodiment of the present invention will be described. Basic constitution and operation of an image forming apparatus 100 of this embodiment are similar to those of the image forming apparatus 100 of Embodiment 1. Accordingly, elements having identical or corresponding functions of constitutions to those of the image forming apparatus of Embodiment 1 are represented by the same reference numerals or symbols as those in Embodiment 1 and will be omitted from detailed description.

In Embodiments 1 to 5, the sandpaper-like fog was positively generated by sufficiently decreasing the Vpp of the charging AC in the supplying operation and then the toner was deposited on the photosensitive drum 1. As described above, by sufficiently decreasing the Vpp of the charging AC, not only the toner having a relatively small absolute value of the electric charge can be supplied to the cleaning position d by the generation of the sandpaper-like fog, but also the degree of the vibration is reduced and thus behavior of the cleaning blade 61 can be stabilized. However, the back contrast is decreased by decreasing a difference between the charging DC and the developing DC, whereby the sandpaper-like fog is generated and thus the toner having the relatively small absolute value of the electric charge can be deposited on the photosensitive drum 1. This method is effective, for example, in the case where the Vpp of the charging AC cannot be changed due to a constitution of a high-voltage substrate.

Here, the charging DC when the predetermined region of the photosensitive drum 1 where the toner is moved from the developing sleeve 41 in the supplying operation passes through the charging position a is referred to as "Vdc1", and the charging DC during image formation is referred to as "Vdc2". Further, the developing DC when the above predetermined region passes through the developing position c is referred to as "Vdev1", and the developing DC during image formation is referred to as "Vdev2". According to study by the present inventor, in order to sufficiently suppress the occurrence of the improper cleaning caused due to an excessive amount of the toner deposited on the photosensitive drum 1 in the supplying operation, there is a need that |Vdc1−Vdev1| is more than 0 V. That is, in the case of |Vdc1−Vdev1|=0 V, Vdc1=Vdev1 holds. For this reason, the region of the photosensitive drum 1 charged to the potential Vdc1 at the charging position a in the supplying operation opposes the developing sleeve 41 having the potential Vdev1 at the developing position c, and therefore, the toner is excessively deposited on the photosensitive drum 1. Incidentally, the charging DC is made higher than the developing DC in potential on the same polarity side as the normal charge polarity of the toner. In general, the polarities of the charging DC and the developing DC are the same as the normal charge polarity of the toner, so that the absolute value of the developing DC may only be required to be made larger than the absolute value of the developing DC. That is, in the supplying operation, the controller 50 carries out control so as to satisfy the following relationship:

$$0\ \mathrm{V} < |V_{dc1} - V_{dev1}| < |V_{dc2} - V_{dev2}|$$

Incidentally, based on the fog, in order to supply a sufficient amount of the toner in the supplying operation performed for a sufficiently short time, |Vdc1−Vdev1| may preferably be not more than |Vdc2−Vdev2|−30 V, more preferably be not less than |Vdc2−Vdev2|−50 V. That is, in the constitution of this embodiment, |Vdc1−Vdev1 may preferably be satisfy a relationship: 0 V<|Vdc1−Vdev1|≤70 V, more preferably satisfy a relationship: 0 V<|Vdc1−Vdev1|≤50 V. An upper limit and a lower limit of the back contrast will be further described in Embodiment 7 appearing hereinafter.

Setting of the charging bias and the developing bias during image formation and during supplying operation in this embodiment is as follows.

<Setting During Image Formation>

(Charging Bias)

DC component: −400 V ("Vdc2")

AC component: Vpp=1500 V, f=1.5 kHz, sine wave (Developing Bias)

DC component: −300 V ("Vdev2")

AC component: Vpp=1800 V, f=2.5 kHz, sine wave

Difference between charging DC and developing DC: |Vdc1−Vdev1|=100 V

In this setting, the background fog is suppressed to a reflection density of about 1% which is substantially negligible.

<Setting During Supplying Operation>

(Charging Bias)

DC component: −360 V ("Vdc1")

AC component: Vpp=1500 V, f=1.5 kHz, sine wave (same as during image formation)

(Developing Bias)

DC component: −330 V ("Vdev2")

AC component: Vpp=1800 V, f=2.5 kHz, sine wave (same as during image formation)

Difference between charging DC and developing DC: |Vdc1−Vdev1|=30 V

In this setting, the sandpaper-like fog with a reflection density of about 8% generates. In the supplying operation, a time in which the toner is deposited on the photosensitive drum 1 is 200 msec, a toner deposition width on the photosensitive drum 1 with respect to the rotational direction of the photosensitive drum 1 is 40 mm, and a toner deposition amount on the photosensitive drum 1 is 12 mg. Incidentally, in the supplying operation, the toner caused the sandpaper-like fog deposits in a substantially entirety of an image formable region of the photosensitive drum 1 with respect to the rotational axis direction of the photosensitive drum 1.

In this embodiment, similarly as in Embodiment 1, the supplying operation is executed in a subsequent pre-rotation step after a rotation distance of the photosensitive drum 1 reaches a rotation distance of the photosensitive drum 1 corresponding to that in the case where printing of 100 sheets on a letter size basis is continuously carried out.

Figure 13:
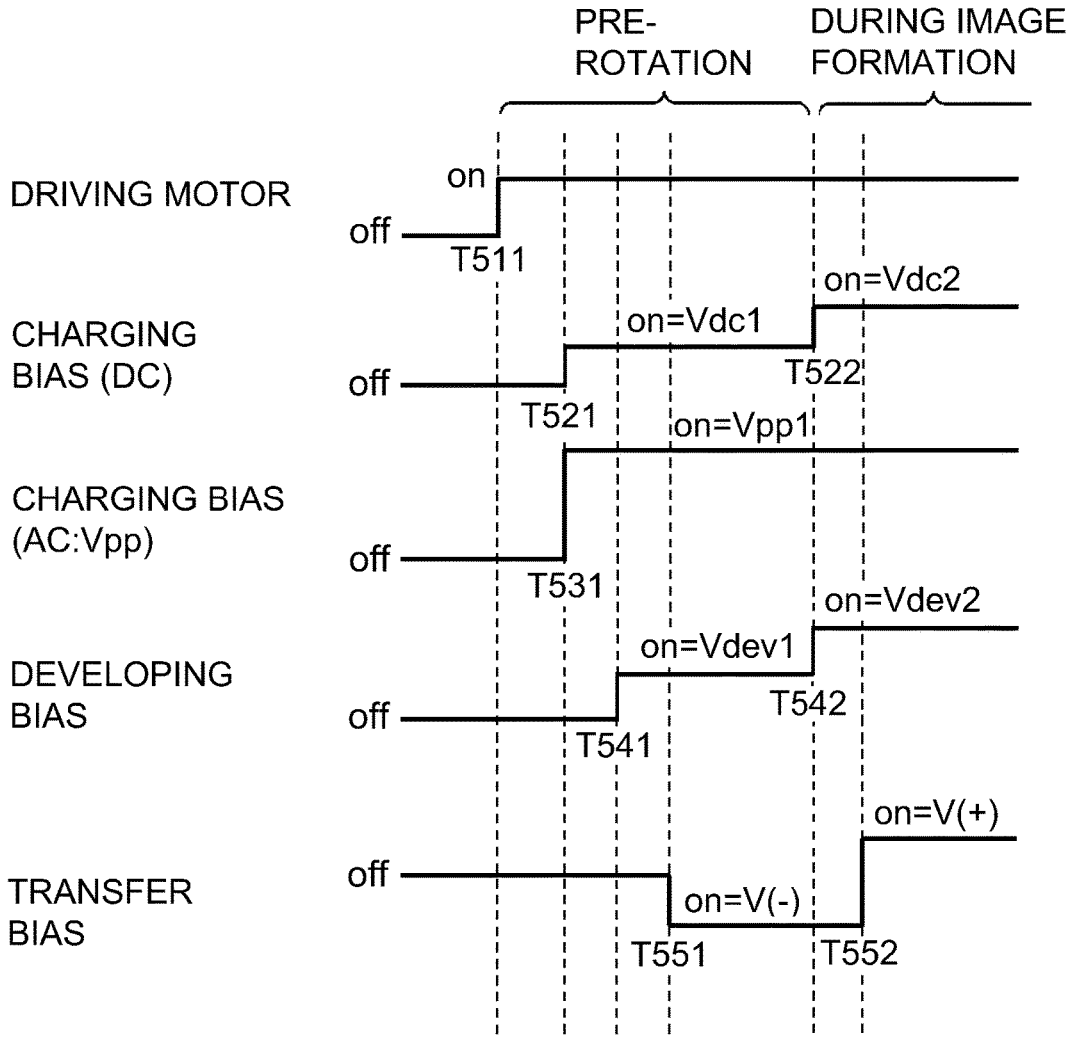
FIG. 13 is a sequence chart of a further example of the supplying operation during the pre-rotation step.

FIG. 13 is a sequence chart showing an example of operation states of respective portions in the case where the supplying operation in this embodiment is executed.

When the pre-rotation step is started, first, drive of the driving motor M1 is started (T511). Then, application of the charging DC and the charging AC is started (T521, T531). At this time, the Vpp of the charging AC is set at a value equal to the value during image formation, and the charging DC is set at "Vdc1". Then, application of the developing DC and the developing AC (in FIG. 13, only the developing DC is shown) is started in synchronism with timing when the position of the photosensitive drum 1 which is the charging position a when the application of "Vdc1" is started reaches the developing position c (T541). At this time, the developing AC is set at a value equal to the value during image formation, and the developing DC is set at "Vdev1". As a result, the background fog generates, and the toner deposits on the photosensitive drum 1. Then, application of the transfer bias of the negative polarity (−500 V in this embodiment) is started in synchronism with timing when the position (the toner caused sandpaper-like fog) of the photosensitive drum 1 which is the charging position a when the application of "Vdc1" is started reaches the transfer position N (T551).

Then, at timing when and after the predetermined region where the background fog should be generated on the photosensitive drum 1 passes through the charging position a, the charging DC is switched to "Vdc2" and the developing DC is switched to "Vdev2", and the sequence goes to the image forming step (T552, T542). Thereafter, application of the transfer bias of the positive polarity (+1500 V in this embodiment) is started in synchronism with timing when the position of the photosensitive drum 1 which is the charging position a at the time when the charging DC and the developing DC are switched to "Vdc2" to "Vdev2", respectively, reaches the transfer position N (T552). In this embodiment, similarly as described in Embodiment 1, the degree of occurrence of the improper cleaning (slip-through) and the degrees of occurrences of the "shuddering" and the "turning-up" were checked, with the result that the improper cleaning, and the "shuddering" and the "turning-up" were able to be sufficiently suppressed. Incidentally, a similar test was conducted after the difference between the charging DC and the developing DC was changed. As a result, when the difference exceeds 70 V (i.e., exceeds |Vdc2−Vdev2|−30 V), it was difficult to sufficiently suppress the improper cleaning due to the "shuddering" in the supplying operation performed for a sufficiently short time. This would be considered because the background fog cannot be sufficiently generated and thus the toner in a sufficient amount cannot be supplied to the cleaning position d.

As described above, according to this embodiment, also by changing the difference between the charging DC and the developing DC, not only the toner can be sufficiently supplied to the contact portion between the photosensitive drum 1 and the cleaning blade 61 during non-image formation but also the occurrence of the improper cleaning can be suppressed by the toner.

Incidentally, for example, as described above in Embodiment 3, the supplying operation may also be executed in the case where the rotation torque of the driving motor M1 for the photosensitive drum 1 is detected and the lubricating property between the photosensitive drum 1 and the cleaning blade 61 is insufficient. That is, the controller 50 is capable of switching the difference between the charging DC and the developing DC during non-image formation. Here, the charging DC when a different region from the predetermined region of the photosensitive drum 1 where the background fog is generated on the photosensitive drum 1 during non-image formation is referred to as "Vdc3", and the developing DC when the different region passes through the developing position c is referred to as "Vdev3". At this time, the controller 50 carries out control of switching of the above-described difference so as to satisfy the following relationship:

$$|Vdc1-Vdev1|<Vdc3-Vdev3|<|Vdc2-Vdev2|$$

In this relationship, |Vdc1−Vdev1| is setting for positively generating the background fog and for supplying the toner to the cleaning position d. |Vdc2−Vdev2| is setting for suppressing the background fog to a negligible level and for forming a desired dark potential during image formation. Further, |Vdc3−Vdc3| is setting for suppressing the background fog to the negligible level and for bringing the surface potential of the photosensitive drum 1 near to the setting during image formation while suppressing the output voltage.

Further, in this embodiment, the difference between the charging DC and the developing DC was changed by changing both of the charging DC and the developing DC, but can also be changed by changing at least one of the charging DC and the developing DC.

Further, the method of discriminating the occurrence or non-occurrence of the execution of the supplying operation described in Embodiments 1 to 3 is also applicable arbitrarily to the case where the toner is deposited on the photosensitive drum 1 by setting the difference between the charging DC and the developing Dc in the supplying operation as in this embodiment.

Embodiment 7

In this embodiment, optimization of high-voltage setting in the supplying operation in consideration of easiness of control and an advantage of a user will be described.

An amount of the toner supplied by the generation of the fog in the supplying operation (herein, this amount is referred to as a "supply amount") is represented by the product of a time of the supplying operation (i.e., a time in which the fog is generated) and an amount per unit area in which the fog was generated (herein, this amount is referred to as a "fog amount (reflection density (%)).

First, description will be made on the basis of Embodiment 1. The Vpp of the charging AC in Embodiment 1 is a means for controlling the fog amount per unit area. With respect to a certain value of the Vpp of the charging AC, a proper time of the supplying operation exists. Execution of the supplying operation for this proper time is desirable for realizing a reduction in toner consumption amount and a reduction is downtime (a time in which the image cannot be outputted due to execution of the adjusting operation).

Figure 15:
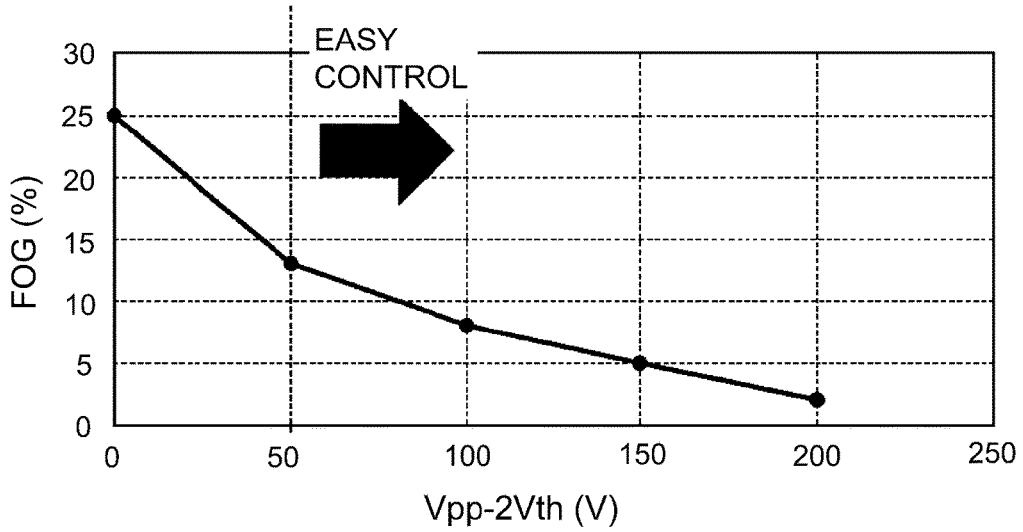
FIG. 15 is a graph showing a relationship between a fog and a charging bias Vpp.
Figure 16:
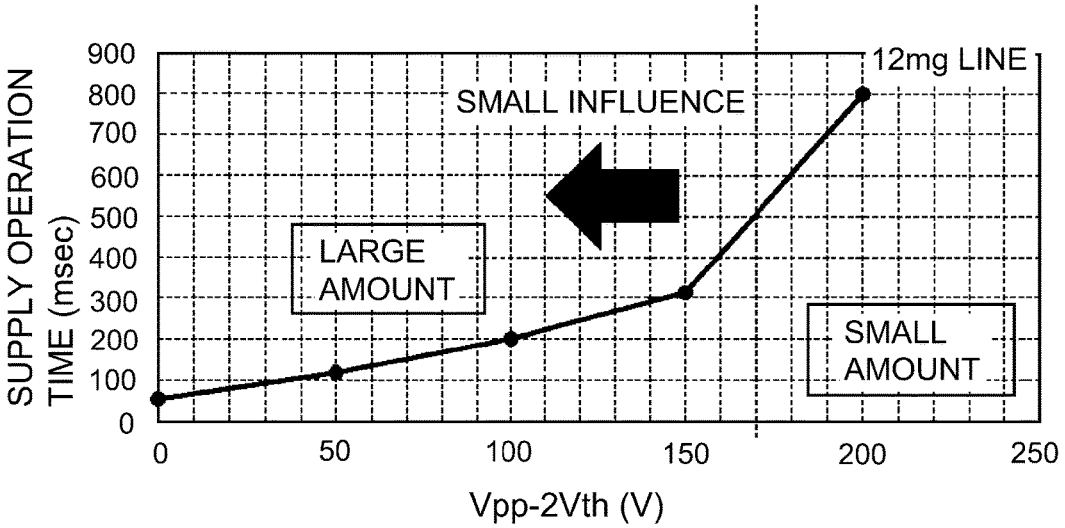
FIG. 16 is a graph showing a relationship between the charging bias Vpp and a supplying operation time.

FIG. 15 is a graph showing a relationship between the Vpp of the charging AC and the fog amount. In FIG. 15, the abscissa represents the Vpp of the charging AC (for convenience, a value thereof from which the discharge start voltage 2Vth is subtracted is shown) and the ordinate represents the fog amount. FIG. 16 is a graph showing a relationship between the Vpp of the charging AC and the supplying operation time which are needed to ensure the supply amount (12 mg) equal to the supply amount in Embodiment 1 in the case where the relationship between the Vpp of the charging AC and the fog amount shown in FIG. 15 is satisfied. In FIG. 16, the abscissa represents the Vpp of the charging AC (for convenience, a value thereof from which the discharge start voltage 2Vth is subtracted is shown), and the ordinate represents the supplying operation time. A region on a left-hand side of a line of the supply amount of 12 mg is a region of an excessive supply amount, and a region on a right-hand side of the line is a region of a.

As shown in FIG. 15, the fog amount abruptly rises when the Vpp of the charging AC decreases. A degree of the rise of the fog amount is liable to vary depending on a state of the image forming apparatus, specifically a state of the toner. For that reason, it is difficult to control the fog amount in a region where the fog amount abruptly rises. Therefore, the fog amount can be easily controlled by setting a lower limit of the Vpp of the charging AC so that the Vpp of the charging AC immediately before the fog amount abruptly rises is a threshold. That is, from FIG. 15, it is understood that from a viewpoint of easiness of the control, the Vpp1 of the charging AC in the supplying operation may preferably be set so as to satisfy: 2Vth+50 V≤Vpp1.

On the other hand, in the case where the Vpp of the charging AC is larger than a value indicated by a broken line extending in a vertical direction, the fog amount decreases, and therefore, there is a need to prolong the supplying operation time. Therefore, the advantage of the user can be improved by setting an upper limit of the Vpp of the charging AC so that a degree of the influence of the supplying operation on the down time can be sufficiently reduced. For example, when the supplying operation time is not more than 500 msec, the degree of the influence of the supplying operation on the down time can be regarded as being small. That is, from FIG. 16, it is understood that from a view of the user's advantage (the reduction in down time), the Vpp1 of the charging AC in the supplying operation may preferably be set so as a to satisfy:

$$Vpp1 \leq 2Vth + 170 \text{ V}.$$

Figure 17:
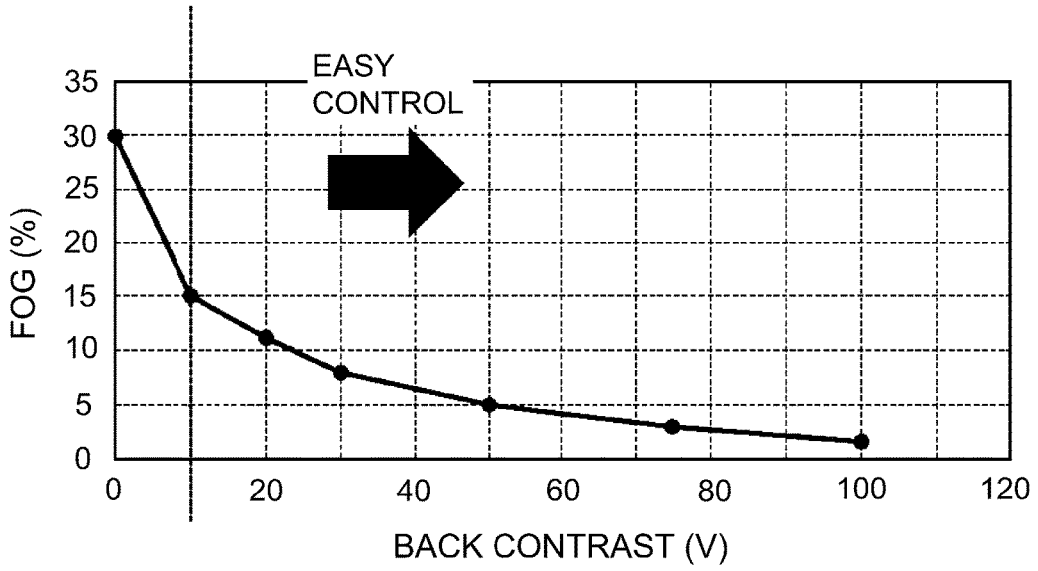
FIG. 17 is a graph showing a relationship between the fog and a back contrast.
Figure 18:
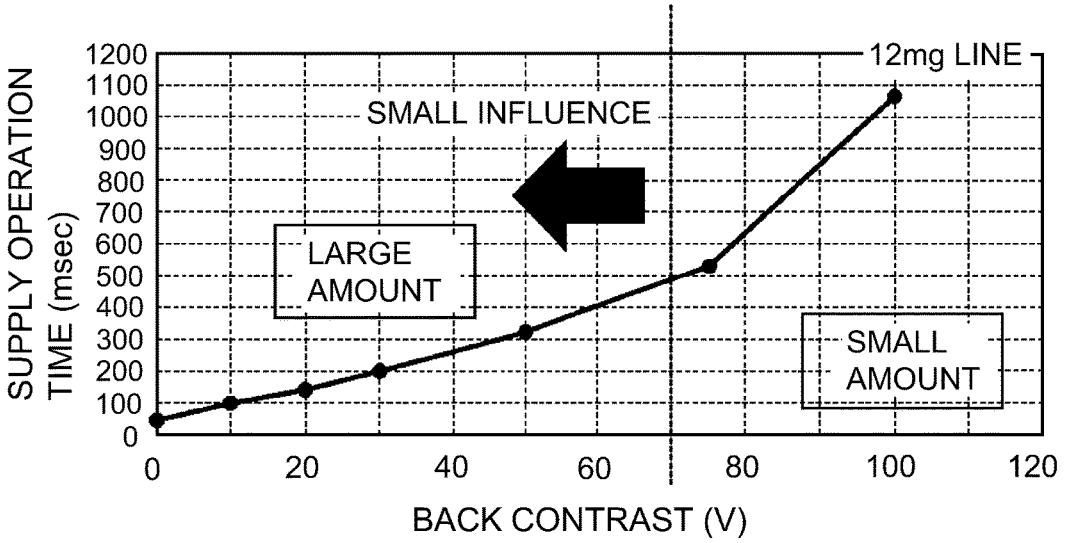
FIG. 18 is a graph showing a relationship between the back contrast and the supplying operation time.

Similarly, as regards the back contrast which is the means for controlling the fog amount per unit area in Embodiment 6, an upper limit and a lower limit can be set from the viewpoints of the easiness of the control and the user's advantage. FIG. 17 is a graph showing the back contrast and the fog amount. From FIG. 17, it is understood that from the viewpoint of the easiness of the control, the back contrast in the supplying operation may preferably be set so that as a threshold, a value of the back contrast immediately before the fog amount abruptly rises satisfies: $10V \leq |Vdc1 - Vdev1|$. Further, FIG. 18 is a graph showing a relationship between the back contrast and the supplying operation time which are needed for ensuring the supply amount (12 mg) equal to the supply amount in Embodiment 6 in the case where the relationship between the back contrast and the fog amount shown in FIG. 17 is satisfied. From FIG. 18, it is understood that from the viewpoint of the user's advantage (the reduction in downtime), the back contrast in the supplying operation may preferably be set so as to satisfy: $|Vdc1 \hat{} Vdev1| \leq 70$ V in a condition that 500 msec is a threshold.

Other Embodiments

In the above, the present invention was described based on specific embodiments, but is not limited thereto.

In the case where the sandpaper-like fog is generated by decreasing the Vpp of the charging AC in the supplying operation, the surface potential of the photosensitive drum immediately before the supplying operation is performed may preferably be substantially 0 V in an almost entire region of the image formable region. This is because in the case where the sandpaper-like fog is generated by decreasing the Vpp of the charging AC and thus by lowering the potential-leveling effect, the lowering in potential-leveling effect cannot be expected even when the Vpp of the charging AC is decreased on the surface of the photosensitive drum on which the substantially uniform dark potential equal to the dark potential during image formation is formed. From this viewpoint, the supplying operation may preferably be performed during the pre-rotation step (as in Embodiment 1 or the like) in which the surface potential of the photosensitive drum immediately before the supplying operation is performed is substantially 0 V in the almost all region of the image formable region. However, a discharging means for removing at least a part of the electric charges on the surface of the photosensitive drum at a discharging position disposed downstream of the transfer position and upstream of the charging position with respect to the rotational direction of the photosensitive drum may also be provided. As the discharging means, for example, a pre-exposure means for exposing the photosensitive drum to light at the discharging position can be used. Further, the surface potential when the region of the photosensitive drum on which the sandpaper-like fog is generated in the supplying operation reaches the charging position may preferably be made substantially 0 V in the almost all image formable region. As a result, electric discharge generates between the photosensitive drum and the charging roller when the predetermined region of the photosensitive drum on which the sandpaper-like fog should be generated passes through the charging position, so that appropriate charging non-uniformity can be caused to occur. In this case, even in the case where the supplying operation is executed in the sheet interval step (Embodiment 4) or the post-recording material step (Embodiment 5), the toner in a sufficient amount can be deposited on the photosensitive drum with reliability by the generation of the sandpaper-like fog.

In some cases, the discharge start voltage 2Vth varies depending on various factors such as an installation environment of the image forming apparatus, a change in electric resistance value of the charging roller due to repetitive use, and a change in film thickness of the photosensitive drum due to repetitive use. Here, the installation environment of the image forming apparatus is, for example, at least one of a temperature and a humidity (relative humidity or absolute water content). Accordingly, the range of the above-described Vpp can be set in advance so as to sufficiently satisfy the above-described range in an arbitrary environment in which the image forming apparatus is usable. Alternately, a characteristic of the discharge start voltage 2Vth varying depending on the various factors is obtained in advance by an experiment or the like, and on the basis of the characteristic, the discharge start voltage 2Vth can be estimated in advance of the image formation and the supplying operation. Then, during image formation and during the supplying operation, the Vpp of the charging AC changed depending on the estimated discharge start voltage 2Vth (in the case of the Vpp1 during the supplying operation, the Vpp1 is set so as to satisfy the above-described range in terms of the estimated 2Vth) can be used. Further, in the image forming apparatus, a current-voltage characteristic is obtained by measuring currents under application of a plurality of test voltages to the charging roller, and then the discharge start voltage 2Vth can be acquired from the characteristic. Typically, at least one of voltages smaller than the discharge start voltage 2Vth and at least one of voltages larger than the discharge start voltage 2Vth and applied to the charging roller, and currents passing through the charging voltage source under the application of the voltages are measured. As a result, a current-voltage characteristic as shown in FIG. 4 can be obtained. Then, the discharge start voltage 2Vth can be acquired from, for example, an infection point of the obtained characteristic (roughly corresponding to the Vpp in the case of a discharge current amount of 0 μA in a characteristic showing a current-voltage characteristic in a range of the voltage larger than the discharge start voltage 2Vth). This operation of acquiring the discharge start voltage 2Vth can be performed during non-image formation at predetermined timing. This predetermined timing can be the case where the environment (at least one of the temperature and the humidity is changed not less than a predetermined range or the case where an index value correlating with a use amount of the charging roller or the photosensitive drum exceeds a predetermined threshold. As the index value correlating with the use amount of the charging roller or the photosensitive drum, it is possible to use arbitrary values such as the number of times of rotation, a rotation time, a time in which the charging process is performed, and the number of sheets subjected to the image formation.

In the above-described embodiments, an example of the monochromatic image forming apparatus was described, but the present invention is also applicable to a color image forming apparatus. For example, color image forming apparatuses of an intermediary transfer type in which toner images different in color are formed on a plurality of photosensitive drums and are successively primary-transferred onto an intermediary transfer member and then are secondary-transferred onto a recording material or of a direct transfer type in which the toner images are successively transferred onto recording materials carried on a recording material carrying member are well known. In these image forming apparatuses, correspondingly to the respective photosensitive drums, charging rollers, developing devices, transfer rollers (primary transfer rollers), cleaning devices and the like which are similar to those described in the above-described embodiments are provided.

In the above-described embodiments, in order to supply the toner, caused the fog such that the absolute value of the electric charge is relatively small, to the cleaning position via the transfer position, the voltage of the same polarity as the charging polarity of the toner was applied to the transfer roller. As another method, the transfer roller (or the intermediary transfer member or the recording material carrying member) may also be spaced from the photosensitive drum when the toner passes through the transfer position.

The present invention may preferably be applicable to the case where the cleaning blade is used as the cleaning member. However, in the case where the cleaning blade disposed in contact with the photosensitive drum and for which there is a liability of the generation of the improper cleaning due to the rise of the frictional force between itself and the photosensitive drum is used, an effect similar to those of the above-described embodiments can be expected by applying the present invention thereto.

In the above-described embodiments, the case where the charging member contacts the surface of the photosensitive drum which is a member-to-be-charged was described as an example, but is not necessarily be required to contact the surface of the photosensitive drum. When a dischargeable region based on the Paschen's law is provided between the charging member and the photosensitive drum, the charging member may also be disposed in non-contact and proximity to the surface of the photosensitive drum with a gap (spacing) of several tens of for example.

Further, the charging member is not limited to the roller-shaped member, but may also be an endless belt stretched by a plurality of stretching rollers or be a blade-shaped member. Further, the image bearing member is not limited to the drum-shaped photosensitive member (photosensitive drum), but may also be an endless belt-shaped photosensitive member (photosensitive belt). When the image forming apparatus is of an electrostatic recording type, the image bearing member may be a drum-shaped or endless belt-shaped electrostatic recording dielectric member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-104005 filed on May 25, 2017, which is hereby incorporated by reference herein in its entirety.

What is claimed is:

1. An image forming apparatus comprising:

a rotatable image bearing member configured to bear a toner image;

a charging member configured to electrically charge a surface of said image bearing member;

a charging voltage source configured to apply a charging voltage in the form of a DC component biased with an AC component to said charging member;

electrostatic image forming means configured to form an electrostatic image on the charged surface of said image bearing member;

a developing member configured to form the toner image by supplying toner to the electrostatic image formed on said image bearing member;

a developing voltage source configured to apply a developing voltage to said developing member;

transfer means configured to transfer the toner image from said image bearing member onto a toner image receiving member at a transfer position;

a cleaning member contacting said image bearing member on a side downstream of the transfer position and upstream of a contact position with said charging member with respect to a rotational direction of said image bearing member; and a controller capable of causing said charging voltage source and said developing voltage source to apply the charging voltage and the developing voltage to said charging member and said developing member, respectively, for moving the toner from said developing member onto said image bearing member so as to execute a supplying operation for supplying the toner to said cleaning member during non-image formation, wherein said controller carries out control so that a peak-to-peak voltage of the AC component of the charging voltage satisfying the following relationship is applied to said charging member so as to execute the supplying operation:

$$2Vth(V) \leq Vpp1(V) \leq (2Vth+200)(V),$$

where a discharge start voltage of the DC component of the charging voltage between said image bearing member and said charging member is Vth (V), and the peak-to-peak voltage of the AC component of the charging voltage applied during execution of the supplying operation is Vpp1 (V), wherein a peak-to-peak voltage of the AC component of the charging voltage applied during image formation is larger than the peak-to-peak voltage Vpp1 (V).

2. An image forming apparatus according to claim 1, wherein said controller is capable of switching the peak-to-peak voltage of the AC component of the charging voltage during non-image formation and carries out control of the switching so as to satisfy the following relationship:

$$Vpp1(V) < Vpp3(V) < Vpp2(V),$$

where the peak-to-peak voltage of the AC component of the charging voltage applied during image formation is Vpp2 (V), and a peak-to-peak voltage of the AC component of the charging voltage when a region on said image bearing member, different from a region on said image bearing member where a potential is formed by applying the peak-to-peak voltage Vpp1 to said charging member, passes through a contact position with said charging member is Vpp3 (V).

3. An image forming apparatus according to claim 1, wherein the peak-to-peak voltage Vpp1 (V) satisfies the following relationship:

$$(2Vth+50)(V) < Vpp1(V) < (2Vth+170)(V).$$

4. An image forming apparatus according to claim 1, further comprising a transfer voltage source configured to apply a DC voltage to said transfer means, wherein said controller carries out control so that a voltage of a polarity, opposite in polarity to a voltage applied during image formation, is applied to said transfer means when a region on said image bearing member where a potential is formed by applying the peak-to-peak voltage Vpp1 (V) to said charging member passes through the transfer position.

5. An image forming apparatus according to claim 1, wherein when a region on said image bearing member where a potential is formed by applying the peak-to-peak voltage Vpp1 (V) to said charging member passes through the contact position with said charging member, electric discharge generates between said image bearing member and said charging member.

6. An image forming apparatus according to claim 1, wherein a potential in a region on said image bearing member where the potential is formed by applying the peak-to-peak voltage Vpp1 (V) to said charging member is substantially 0 V when the region reaches the contact position with said charging member.

7. An image forming apparatus according to claim 1, wherein said controller executes the supplying operation in a pre-rotation step prior to an image forming step.

8. An image forming apparatus according to claim 1, wherein when an index value correlating with a frictional force between said image bearing member and cleaning member satisfies a predetermined condition, said controller carries out control so as to execute the supplying operation during non-image formation.

9. An image forming apparatus according to claim 1, further comprising counting means configured to count an index value correlating with a movement distance of said image bearing member with respect to a rotational direction of said image bearing member, wherein when a counting result of said counting means is not less than a threshold, said controller carries out control so as to execute the supplying operation during non-image formation.

10. An image forming apparatus according to claim 9, wherein said counting means counts the index value correlating with the movement distance of said image bearing member with respect to the rotational direction during non-image formation.

11. An image forming apparatus according to claim 9, further comprising temperature detecting means configured to detect a temperature of an inside portion or an outside portion of a main assembly of said image forming apparatus, wherein the temperature includes a first temperature and a second temperature higher than the first temperature, wherein said controller changes the threshold depending on a detection result of said temperature detecting means so that the threshold when the temperature is the second temperature is larger than the threshold when the temperature is the first temperature.

12. An image forming apparatus according to claim 9, further comprising:

a developing device including said developing member and a developing container containing the toner; and use amount counting means configured to count an index value correlating with a use amount of said developing device, wherein a counting result of said use amount counting means includes a first value and a second value higher than the first value, wherein said controller changes the threshold depending on the counting result so that the threshold when the counting result is the second value is smaller than the threshold when the counting result is the first value.

13. An image forming apparatus according to claim 1, further comprising toner counting means configured to count an index value correlating with an amount of the toner supplied to said image bearing member while said image bearing member moves a predetermined distance in a rotational direction of said image bearing member, wherein when a counting result of said counting means is not more than a threshold, said controller carries out control so as to execute the supplying operation during non-image formation.

14. An image forming apparatus according to claim 13, further comprising temperature detecting means configured to detect a temperature of an inside portion or an outside portion of a main assembly of said image forming apparatus, wherein the temperature includes a first temperature and a second temperature higher than the first temperature, wherein said controller changes the threshold depending on a detection result of said temperature detecting means so that the threshold when the temperature is the second temperature is smaller than the threshold when the temperature is the first temperature.

15. An image forming apparatus according to claim 13, further comprising:

a developing device including said developing member and a developing container containing the toner; and use amount counting means configured to count an index value correlating with a use amount of said developing device, wherein a counting result of said use amount counting means includes a first value and a second value higher than the first value, wherein said controller changes the threshold depending on the counting result so that the threshold when the counting result is the second value is larger than the threshold when the counting result is the first value.

16. An image forming apparatus according to claim 1, further comprising temperature detecting means configured to detect a temperature of an inside portion or an outside portion of a main assembly of said image forming apparatus, wherein when the temperature detected by said temperature detecting means is not more than a threshold, said controller carries out control so as to execute the supplying operation during non-image formation.

17. An image forming apparatus according to claim 1, further comprising:

a developing device including said developing member and a developing container containing the toner; and use amount counting means configured to count an index value correlating with a use amount of said developing device, wherein when a counting result of said use amount counting means is not less than a threshold, said controller carries out control so as to execute the supplying operation during non-image formation.

18. An image forming apparatus according to claim 1, further comprising torque detecting means configured to detect an index value correlating with a rotational torque of a driving motor for driving said image bearing member, wherein when a detection result of said torque detecting means is not less than a threshold, said controller carries out control so as to execute the supplying operation during non-image formation.

19. An image forming apparatus comprising:

a rotatable image bearing member configured to bear a toner image;

a charging member configured to electrically charge a surface of said image bearing member;

a charging voltage source configured to apply a charging voltage in the form of a DC component biased with an AC component to said charging member;

electrostatic image forming means configured to form an electrostatic image on the charged surface of said image bearing member;

a developing member configured to form the toner image by supplying toner to the electrostatic image formed on said image bearing member;

a developing voltage source configured to apply a developing voltage including at least a DC component to said developing member;

transfer means configured to transfer the toner image from said image bearing member onto a toner image receiving member at a transfer position;

a cleaning member contacting said image bearing member on a side downstream of the transfer position and upstream of a contact position with said charging member with respect to a rotational direction of said image bearing member; and a controller capable of causing said charging voltage source and said developing voltage source to apply the charging voltage and the developing voltage to said charging member and said developing member, respectively, for moving the toner from said developing member onto said image bearing member so as to execute a supplying operation for supplying the toner to said cleaning member during non-image formation, wherein said controller carries out control so that the DC component of the charging voltage and the DC component of the developing voltage which satisfy the following relationship are applied to said charging member and said developing member, respectively, so as to execute the supplying operation:

$$0(V)<|Vdc1-Vdev1|(V)<|Vdc2-Vdev2|(V),$$

where the DC component of the charging voltage applied during execution of the supplying operation is Vdc1 (V), the DC component of the charging voltage applied during image formation is Vdc2 (V), the DC component of the developing voltage applied during execution of the supplying operation is Vdev1 (V), and the DC component of the developing voltage applied during image formation is Vdev2 (V).

20. An image forming apparatus according to claim 19, wherein said controller is capable of switching, during non-image formation, a difference between the DC component of the charging voltage and the DC component of the developing voltage and carries out control of the switching so as to satisfy the following relationship:

$$|Vdc1-Vdev1|(V)<|Vdc3-Vdev3|(V)<|Vdc2-Vdev2|(V),$$

where a DC component of the charging voltage applied to said charging member when a predetermined region on said image bearing member, different from a region on said image bearing member where a potential is formed by applying the DC component Vdc1 to said charging member, passes through a contact position with said charging member is Vdc3 (V), and a DC component of the charging voltage applied to said charging member when the predetermined region on said image bearing member passes through a contact position with said developing member is Vdev3 (V).

21. An image forming apparatus according to claim 19, wherein the |Vdc1−Vdev1|(V) satisfies the following relationship:

$$10(V)\leq|Vdc1-Vdev1|(V)\leq(Vdc2-Vdev2|-30)(V).$$

* * * * *